US007485034B2

(12) United States Patent
Sells

(10) Patent No.: US 7,485,034 B2
(45) Date of Patent: Feb. 3, 2009

(54) VENT FOR TILE ROOFS

(75) Inventor: Gary L Sells, South Bend, IN (US)

(73) Assignee: Cor-A-Vent, Inc., Mishawaka, IN (US)

( * ) Notice: Subject to any disclaimer, the term of this patent is extended or adjusted under 35 U.S.C. 154(b) by 297 days.

(21) Appl. No.: 11/005,455

(22) Filed: Dec. 6, 2004

(65) Prior Publication Data

US 2006/0121845 A1 Jun. 8, 2006

(51) Int. Cl.
*F24F 7/02* (2006.01)

(52) U.S. Cl. ..... 454/365

(58) Field of Classification Search ..... 454/365
See application file for complete search history.

(56) References Cited

U.S. PATENT DOCUMENTS

| | | | | |
|---|---|---|---|---|
| 94,203 | A | 8/1869 | Hayes | |
| 183,532 | A | 10/1876 | Brock | |
| 1,307,228 | A | 6/1919 | Wickstrom | |
| 4,545,292 | A * | 10/1985 | Inokawa et al. | 454/365 |
| 5,797,222 | A * | 8/1998 | Martin | 52/198 |
| 6,447,390 | B1 * | 9/2002 | O'Hagin | 454/250 |
| 6,537,147 | B2 | 3/2003 | Smith | |
| 6,554,700 | B2 | 4/2003 | Dixon | |
| 6,647,675 | B1 * | 11/2003 | Castellanos | 52/198 |
| 6,662,509 | B2 | 12/2003 | Sharp et al. | |
| 2004/0000101 | A1 | 1/2004 | Dixon | |

FOREIGN PATENT DOCUMENTS

| | | | |
|---|---|---|---|
| JP | 2003-239480 | A | 8/2003 |

* cited by examiner

*Primary Examiner*—Steve Mcallister
*Assistant Examiner*—Helena Kosanovic
(74) *Attorney, Agent, or Firm*—Baker & Daniels LLP

(57) ABSTRACT

A ventilating apparatus for a roof having a longitudinally extending ridge member and a vent opening substantially co-extensive with the ridge member, that in one embodiment includes a vent member mounted above the ridge member and extending longitudinally along the length of the vent opening, the vent member including a plurality of vent passages communicating the vent opening to ambient atmosphere; and the vent member including an upper wall, a pair of side walls, a pair of lower walls, and a pair of flexible mounting flanges that provide an adjustable mount to the roof on opposite sides of the vent opening. The vent member can accommodate vent openings of different widths. The ventilating apparatus also includes a capping structure extending longitudinally above the ridge member, covering the ridge member and the vent opening so that air ventilating from the vent opening passes within a space between said capping structure and the roof. The ventilating apparatus may further include a pair of deflector members mounted on opposite sides of the vent member with each of the deflector members extending outwardly beyond the respective side wall. The mounting flanges of the ventilating apparatus may be adjustably fixed to the vent member to permit the height of the ventilating apparatus to be adjusted.

32 Claims, 21 Drawing Sheets

VENT FOR TILE ROOFS

BACKGROUND

The present invention relates to a roof ridge vent for use in building construction to enhance the circulation of air in a space between the roof and an underlying ceiling structure, and more particularly, to a ridge vent for use with tile roofing.

It is well known in the construction industry that the attic space of a building should be well ventilated. Ideally, the ventilation system would provide sufficient air flow to keep the air temperature in the attic close to the outside air temperature. Adequate ventilation reduces the buildup of heat in the attic during summer months, which can substantially reduce cooling costs, and other problems associated with excessive heat. During cooler periods, attic ventilation assures that moisture that migrates out of interior spaces and through the insulation does not remain trapped in the attic space and re-condense on or in the attic insulation.

Numerous devices have evolved over the years for providing attic ventilation. Such devices include simple gable vents to provide cross ventilation, passive ventilation systems, which typically combine vents placed under the eaves or soffits at the lowermost portion of the attic with passive roof vents located at strategic positions along the slope of the roof, and active roof ventilation systems, which traditionally include thermostats that activate fans above a predetermined temperature to force hot air out of the attic.

Of the passive ventilation systems, ridge ventilation is one of the most effective. Ridge vent systems generally include a long opening formed along the apex or ridge of a roof. This vent opening is created during construction by leaving a gap between the roof deck and the roof beam running along the ridge extending essentially the length of the roof. The ridge vent is designed to work from convection, wherein warmer lighter air rises in the attic space and is exhausted through the ridge vent and then replaced by cooler air entering through the soffit vents. The venting operation is assisted by suction created by wind blowing over the ridge, which acts to draw air out of the ridge vent.

In ridge vent systems, the vent slot must be covered to keep water, dirt and pests out of the structure. Even though the vent slot is covered, rain or snow can be driven into the roof opening during storms with sufficiently high winds. The unique configuration of tile roofing applications provides a particular challenge to allow sufficient venting from the vent opening, while preventing moisture, dirt, debris and pests from entering through the opening.

One ridge vent apparatus for use on a tile roof is disclosed in U.S. Pat. No. 4,545,292 to Inokawa et al., which is incorporated herein in its entirety by reference. The ridge ventilation apparatus disclosed by Inokawa is shaped substantially identical to the ridge tiles, and ends of a top frame are fixed to the ends of the ridge tiles. The ventilation apparatus has numerous parts including a hinged top frame having inner and outer exhaust ports, and a lower frame having water drain ports.

Other ridge vents for tile roofs are disclosed in U.S. Pat. No. 6,554,700 B2 and U.S. Patent Application Publication Number US 2004/0000101 A1, both to Dixon and which are incorporated by reference in their entirety herein. Dixon discloses ridge vents including a main body portion having a pair of eaves and a neck portion. The neck portion may include expandable accordion-like panels for length adjustment and may also include projections for mounting to a nailer board on the roof. The eaves of the ridge vent include exhaust vents slots. In one embodiment, a blocking panel may be secured to the nailer board to help block rain, snow, etc., from entering through the slots in the eaves. Alternately, cover plates that may include vent openings may be secured to the main body portion to help cover and block the exhaust slots from view.

While these prior art developments offer some approaches to providing a ridge vent for a tile roof that both vents air from a building and prevents rain or snow from entering the opening in the building, there is still a need for an improved ridge vent for tile roofs that can be economically made and is versatile in use, and yet will prohibit rain and snow from entering the vent opening in the building. These and other objects of the present invention have been accomplished.

SUMMARY OF THE INVENTION

It is a feature of the invention to provide a ventilating apparatus for a roof having a longitudinally extending ridge member and a vent opening substantially co-extensive with the ridge member, that in one embodiment includes a vent member mounted above the ridge member and extending longitudinally along the length of the vent opening, the vent member including a plurality of vent passages communicating the vent opening to ambient atmosphere; and the vent member including an upper wall, a pair of side walls, a pair of lower walls, and a pair of flexible mounting flanges that provide an adjustable mount to the roof on opposite sides of the vent opening. The vent member can accommodate vent openings of different widths. The ventilating apparatus also includes a capping structure extending longitudinally above the ridge member, covering the ridge member and the vent opening so that air ventilating from the vent opening passes within a space between the capping structure and the roof.

The roof that the ventilating apparatus is used on may be covered by tiles. The upper wall can include recessed areas having exhaust ports. The side walls can include drainage holes for draining moisture entering the exhaust ports in the upper wall.

The upper wall of the vent member can be mounted to the capping structure.

The ventilating apparatus may further include a pair of deflector members mounted on opposite sides of the vent member with each of the deflector members extending outwardly beyond the respective side wall. The vent member may have exhaust ports in at least one of the side walls or lower walls. The deflector members may include moisture drainage holes. The deflector members may have a substantially V-shaped configuration and the drainage holes can be located in outer legs of the V-shaped deflector members, slightly above the base of the V.

The mounting flanges of the ventilating apparatus may be adjustably fixed to the vent member to permit the height of the ventilating apparatus to be adjusted.

It is also a feature of the invention to provide another embodiment of a ventilating apparatus for a roof having a longitudinally extending ridge member and a vent opening substantially coextensive with the ridge member, that includes a vent member mounted above the ridge member and extending longitudinally along the length of the vent opening, wherein the vent member includes a plurality of vent passages communicating the vent opening to ambient atmosphere, and the vent member includes an upper wall, a pair of side walls, a pair of lower walls, and a pair of mounting flanges, the upper wall including at least one longitudinally extending gulley having exhaust ports. At least one of the side walls or lower walls may include drainage holes for draining moisture entering the exhaust ports in the upper wall. The ventilating apparatus may also include a capping structure extending longitudinally above the ridge member, covering the ridge member and the vent opening so that air ventilating from the vent opening passes within a space between the capping structure and the roof.

The roof that the ventilating apparatus is used on may be covered by tiles.

The upper wall of the vent member may be mounted to the capping structure.

The ventilating apparatus may further include a pair of deflector members mounted on opposite sides of the vent member with each of the deflector members extending outwardly beyond the respective side wall. The deflector members may include moisture drainage holes. The deflector members may have a substantially V-shaped configuration.

The mounting flanges of the ventilation apparatus may be adjustably fixed to the vent member to permit the height of the ventilating apparatus to be adjusted.

The mounting flanges are of the ventilating apparatus may be flexible to provide an adjustable mount to the roof on opposite sides of the vent opening to accommodate vent openings of different widths.

It is an additional feature of the invention to provide a further embodiment of a ventilating apparatus for a roof having a longitudinally extending ridge member and a vent opening substantially coextensive with the ridge member that includes a vent member mounted above the ridge member and extending longitudinally along the length of the vent opening, wherein the vent member includes a plurality of vent passages communicating the vent opening to ambient atmosphere, the vent member including an upper portion defining an interior cavity and including exhaust ports, and a base portion for mounting the vent member; and a pair of mounting flanges that are mounted to the roof on opposite sides of the vent opening. The mounting flanges are adjustably fixed to the base portion of the vent member to permit the height of the ventilating apparatus to be adjusted.

The vent member may be comprised of a single piece of formed sheet metal. The upper portion may include at least one longitudinally extending recessed gulley wherein the exhaust ports are located for collecting and draining moisture through the exhaust ports into the interior cavity of the vent member. The upper portion may further include drainage holes for draining moisture from the interior cavity.

The ventilating apparatus may further include a pair of deflector members mounted to the base portion of the vent member with one of the deflector members mounted longitudinally along each side thereof. The deflector members may include moisture drainage holes. The deflector members can have a substantially V-shaped configuration, and the drainage holes can be located in outer legs of the V-shaped deflector members.

The mounting flanges of the ventilating apparatus can be flexible to provide an adjustable mount to the roof to accommodate vent openings of different widths.

It is yet another feature of the invention to provide an additional embodiment of a ventilating apparatus for a roof having a longitudinally extending ridge member and a vent opening substantially coextensive with the ridge member that includes a one piece vent member formed from a sheet metal to be mounted above the ridge member and extending longitudinally along the length of the vent opening, wherein the vent member includes a plurality of vent passages communicating the vent opening to ambient atmosphere. The vent member may include an upper wall, a pair of side walls, and a pair of lower walls. The walls define an interior cavity in the vent member, and the upper wall includes at least one longitudinally extending gulley having exhaust ports for the vent passages. The longitudinal gulley and exhaust ports collect and drain water into the interior cavity, and drainage holes can be located in at least one of the side walls or the lower walls for draining moisture from the interior cavity.

The ventilating apparatus may further include a pair of flexible mounting flanges that provide an adjustable mount to the roof on opposite sides of the vent opening to accommodate vent openings of different widths.

The ventilating apparatus may further include mounting flanges adjustably fixed to the vent member to permit the height of the ventilating apparatus to be adjusted.

The ventilating apparatus may further include a filter media. The filter media may be located in the interior cavity. The filter media may also be comprised of a thin elongate air permeable moisture resistant sheet in a figure-8 configuration.

The ventilating apparatus may further include a plurality of projections on the upper wall of said vent member to direct air flowing beneath a ridge cap covering the vent member up towards the ridge cap and out the other side of the ridge cap.

It is also a feature of the invention to provide a method for venting a building or structure including the steps of providing a roof having a longitudinally extending ridge member and a vent opening substantially coextensive with the ridge member; providing a vent member having an upper portion with exhaust ports for venting air and defining an interior cavity, and drain holes for venting any moisture entering the cavity through the exhaust ports and a lower portion for mounting the vent member; providing a pair of flexible mounting flanges attached to the lower portion that serve as a flexible mount on the roof on opposite sides of the vent opening to accommodate vent openings of different widths; pulling the mounting flanges apart and mounting them to the roof on opposite sides of the vent opening using fasteners or adhesive; providing a capping structure; and mounting the capping structure over the vent member to extend longitudinally thereabove.

The upper portion of the vent member may include at least one longitudinally extending gulley wherein the exhaust ports are located in the gulley for directing moisture through the exhaust ports into the interior cavity.

The mounting flanges can be adjustably attached to the lower portion to allow the height of the vent member to be adjusted.

The vent members may include deflector members extending along the length thereof, and the drain holes can be located in the deflector members.

The vent member may include a filter media. The filter media may be an air permeable, moisture resistant membrane located in the interior cavity. The filter media may also be an elongate sheet of material folded in a figure-8 configuration.

The upper portion of the vent member may include projections that direct flowing air and moisture up towards the capping structure and out the other side thereof.

BRIEF DESCRIPTION OF THE DRAWINGS

The above-mentioned and other features and objects of this invention and the manner of obtaining them will become more apparent, and the invention itself will be better understood by reference to the following description of embodiments of the present invention taken in conjunction with the accompanying drawings, wherein.

Figure 1:
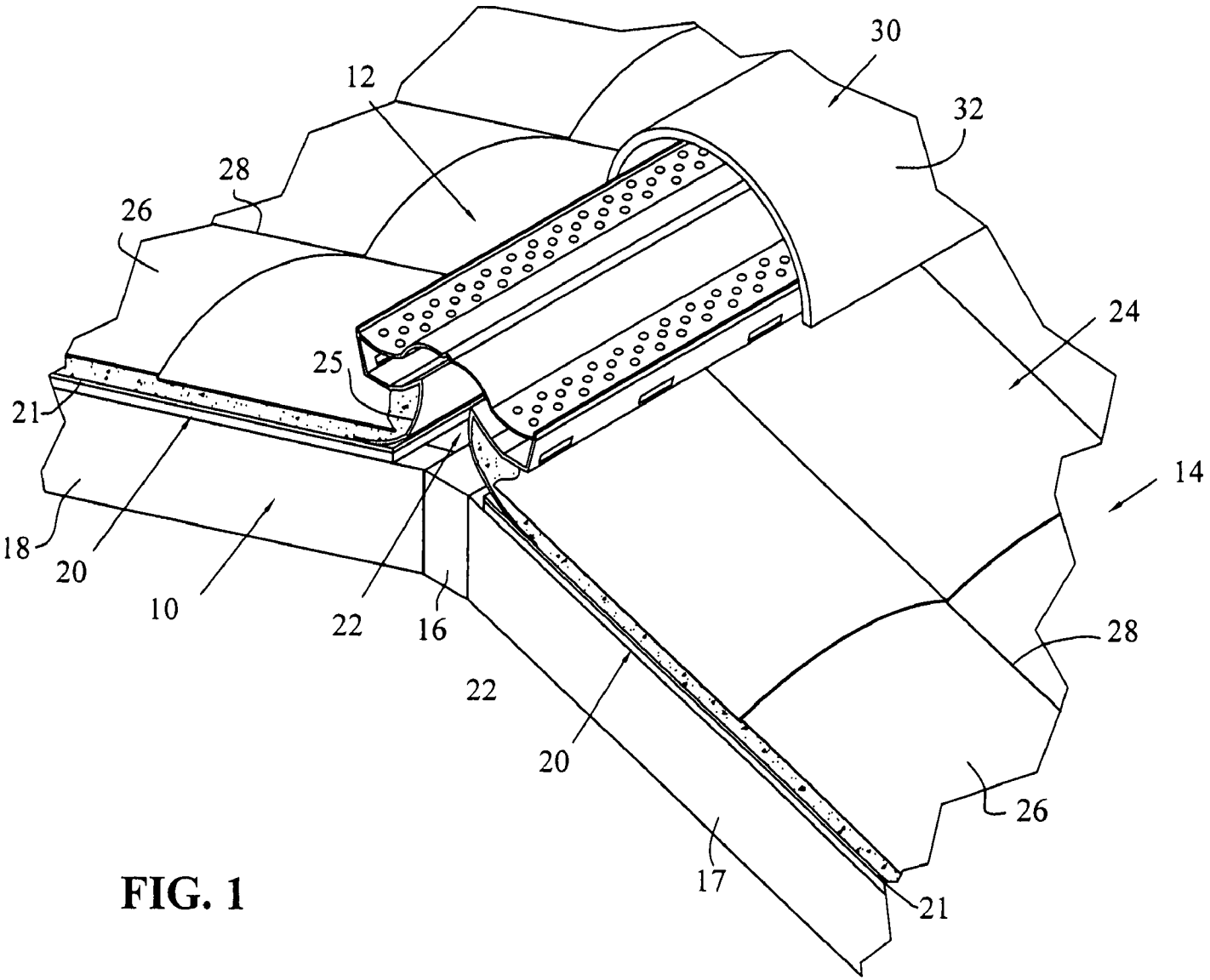
FIG. 1 is a partial top perspective view of a structure having a ridge vent according to one embodiment of the present invention with one of the capping tiles removed to better show the ridge vent.
Figure 2:
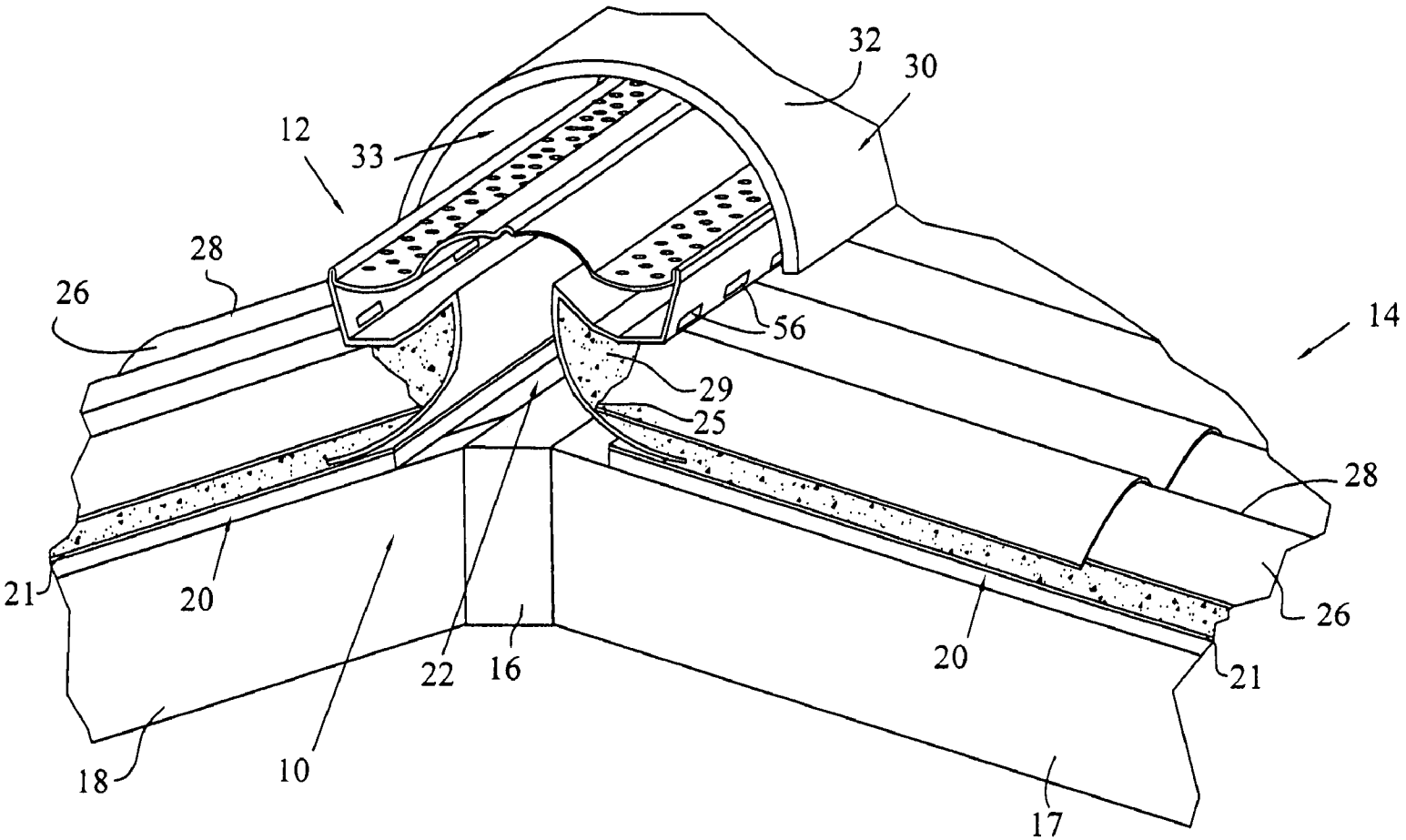
FIG. 2 is a partial perspective view of the ridge vent of FIG. 1 at a different angle.
Figure 3:
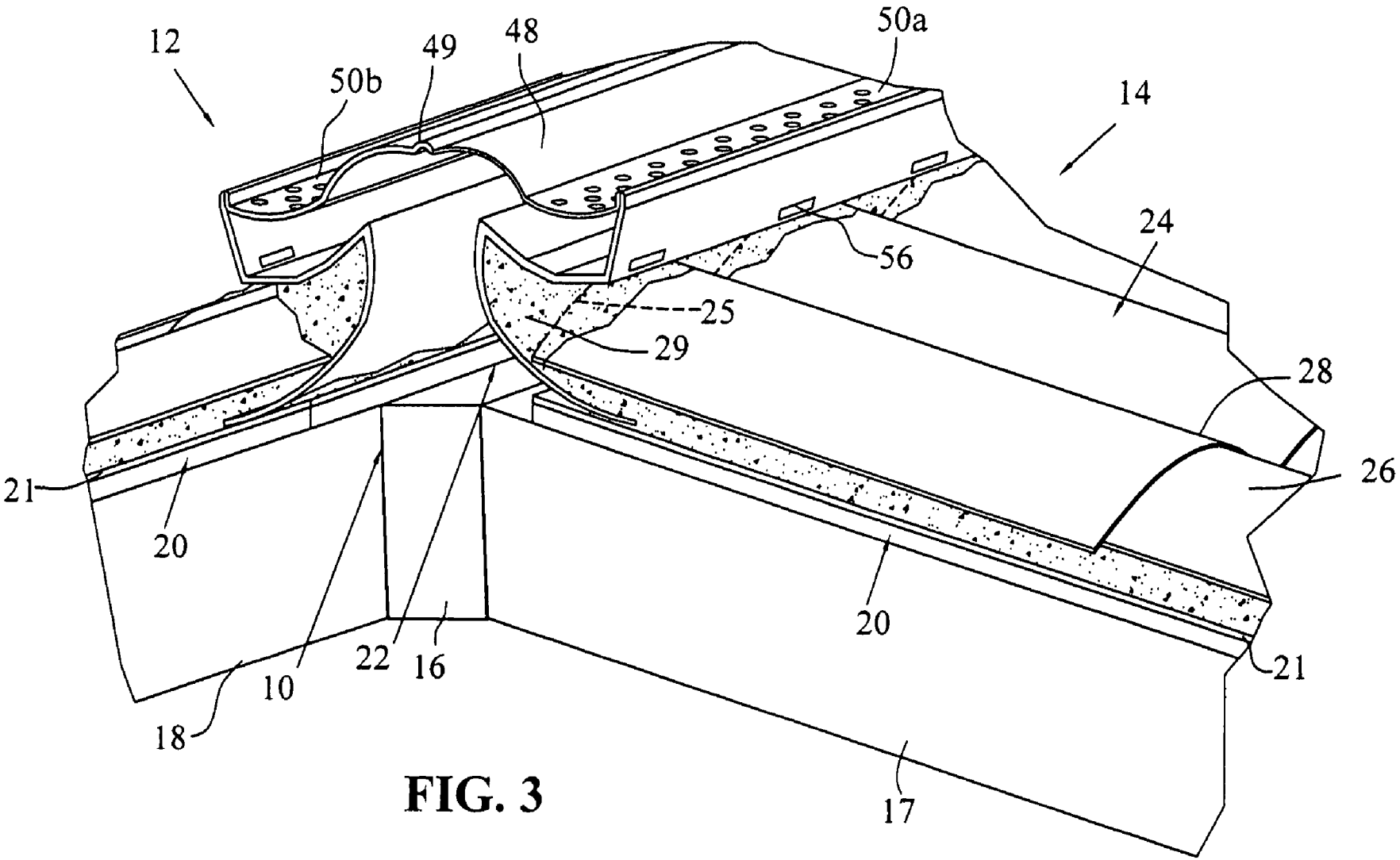
FIG. 3 is a partial perspective view of the ridge vent of FIG. 1 similar to FIG. 2 with the cap tiles removed.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms, and such exemplifications are not to be construed as limiting the scope of the invention in any manner.

DETAILED DESCRIPTION OF THE EMBODIMENT

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIGS. 1-5, a first embodiment of a ventilating apparatus is generally indicated as 10. Ventilating apparatus 10 includes a vent member generally indicated as 12 for mounting on a roof generally indicated as 14. Roof 14 includes a longitudinally extending ridge member 16 and transversely spaced incline rafters 17, 18. Rafters 17, 18 are covered by underlayment or sheathing generally indicated as 20. A membrane 21 covers sheathing 20 to help provide moisture resistance. The membrane may be made from a moisture repelling polymer, felt material, or tar paper, as are all known in the industry. A portion of sheathing 20 adjacent the ridge member 16 is cut away or assembled in a manner to define a vent opening generally indicated as 22, which extends longitudinally along both sides of ridge member 16. Typically, the sheathing or underlayment 20 can be covered by a layer of felt paper (not shown). Roofing tiles 24 are applied to the sheathing or underlayment 20 to complete the roof. Installed tiles 24 have an edge 25 and produce a ridge effect having alternating peaks 26 and valleys 28. For the purposes of this discussion, a Spanish-style tile is displayed; however, this is not critical to the invention and no limitation is intended thereby. The area between edge 25 and vent member 12 is sealed with a mortar or mastic material 29.

Vent member 12 is mounted above the vent opening 22 and extends longitudinally along the length thereof. Vent member 12 and vent opening 22 are covered by a ridge cap generally indicated as 30, which is formed from a series of semi-circular ridge tile pieces 32. With respect to ridge cap 30, there is created an air space generally indicated as 33 underneath the ridge cap 30 and is open to atmospheric conditions through the tile valleys 28.

Figure 4:
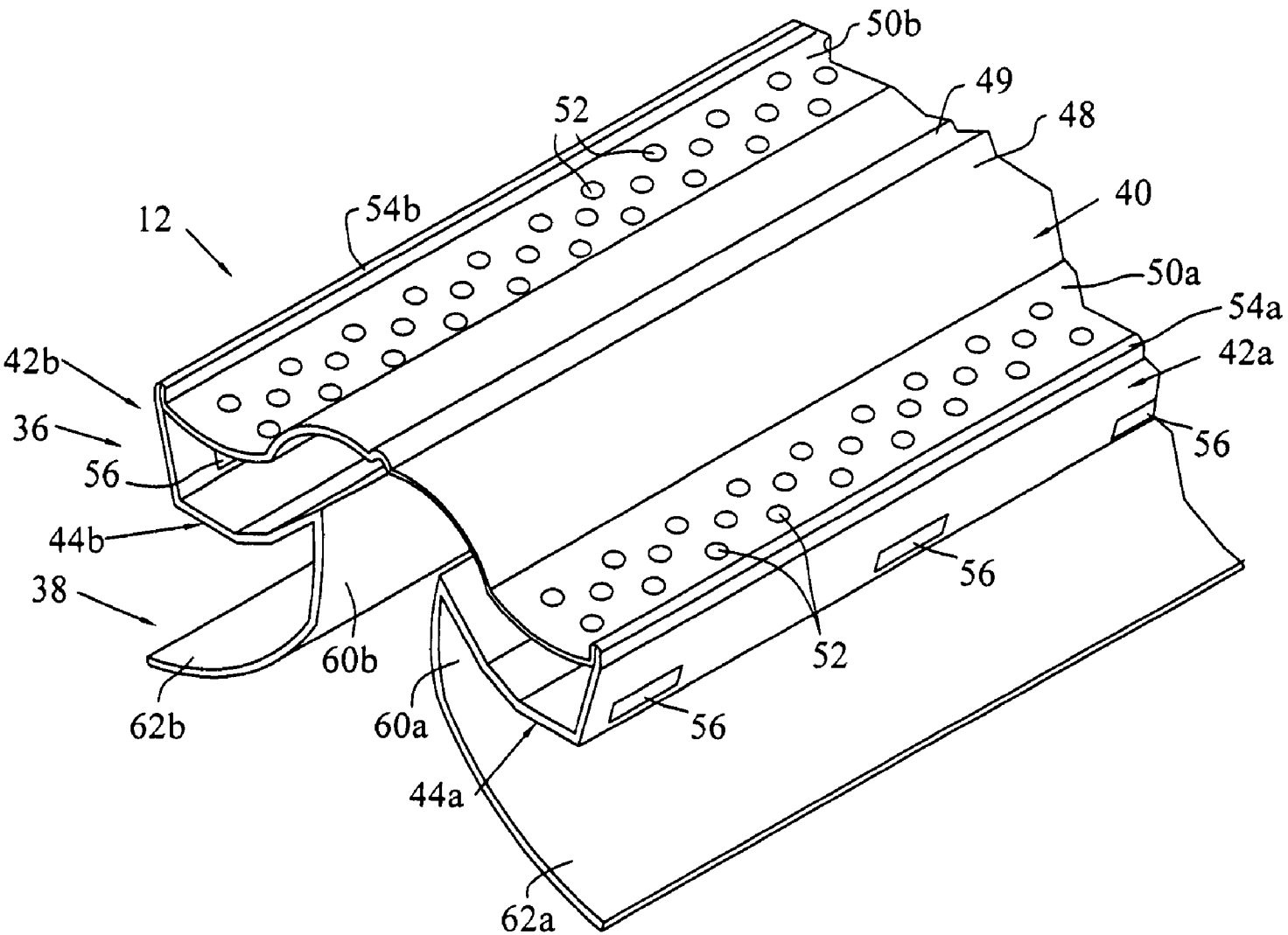
FIG. 4 is a partial perspective view of the ridge vent removed from the roof.
Figure 5:
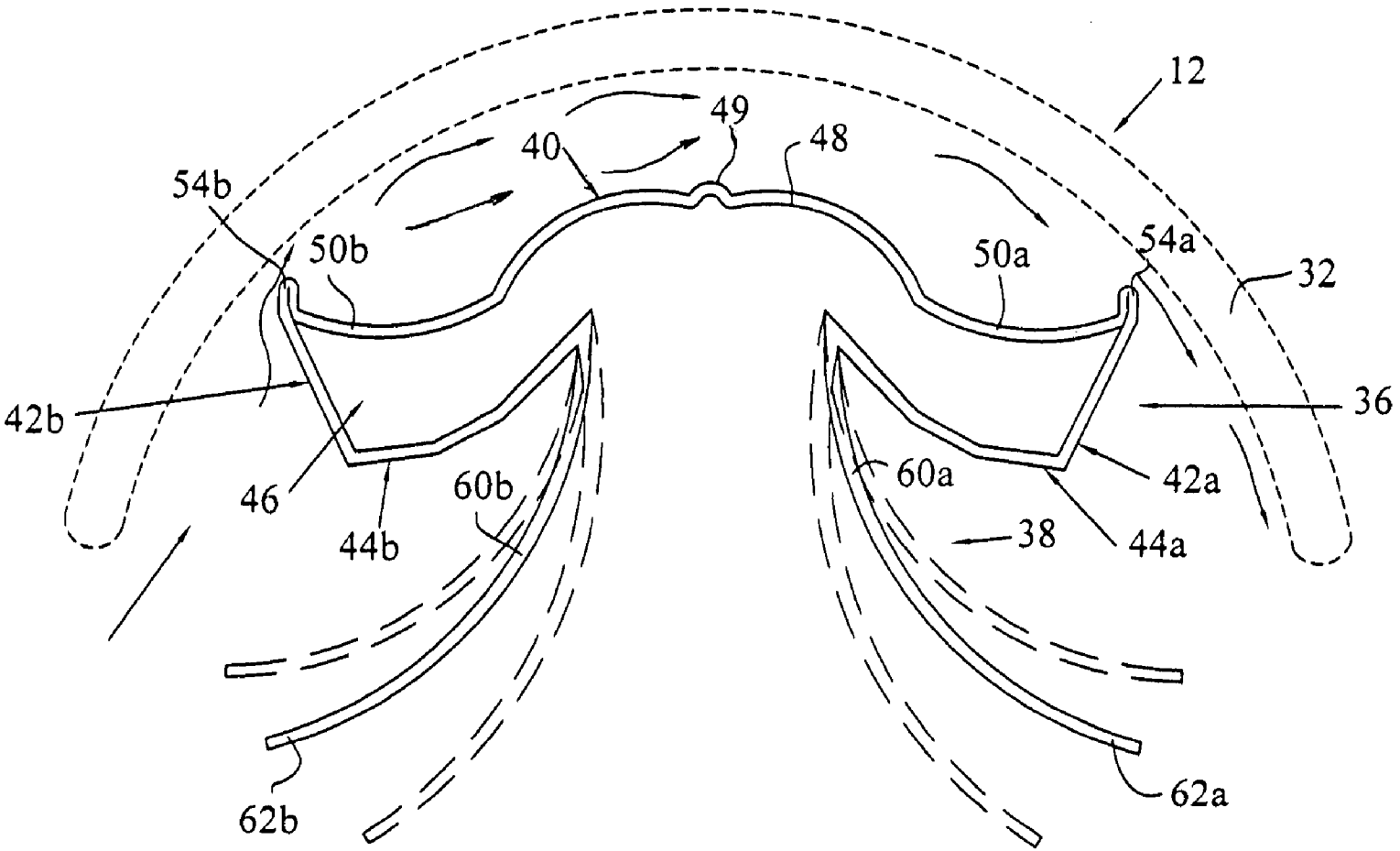
FIG. 5 is an end view of the ridge vent of FIG. 1 removed from the roof and showing various positions for flexible mounting flanges in phantom lines.
Figure 6:
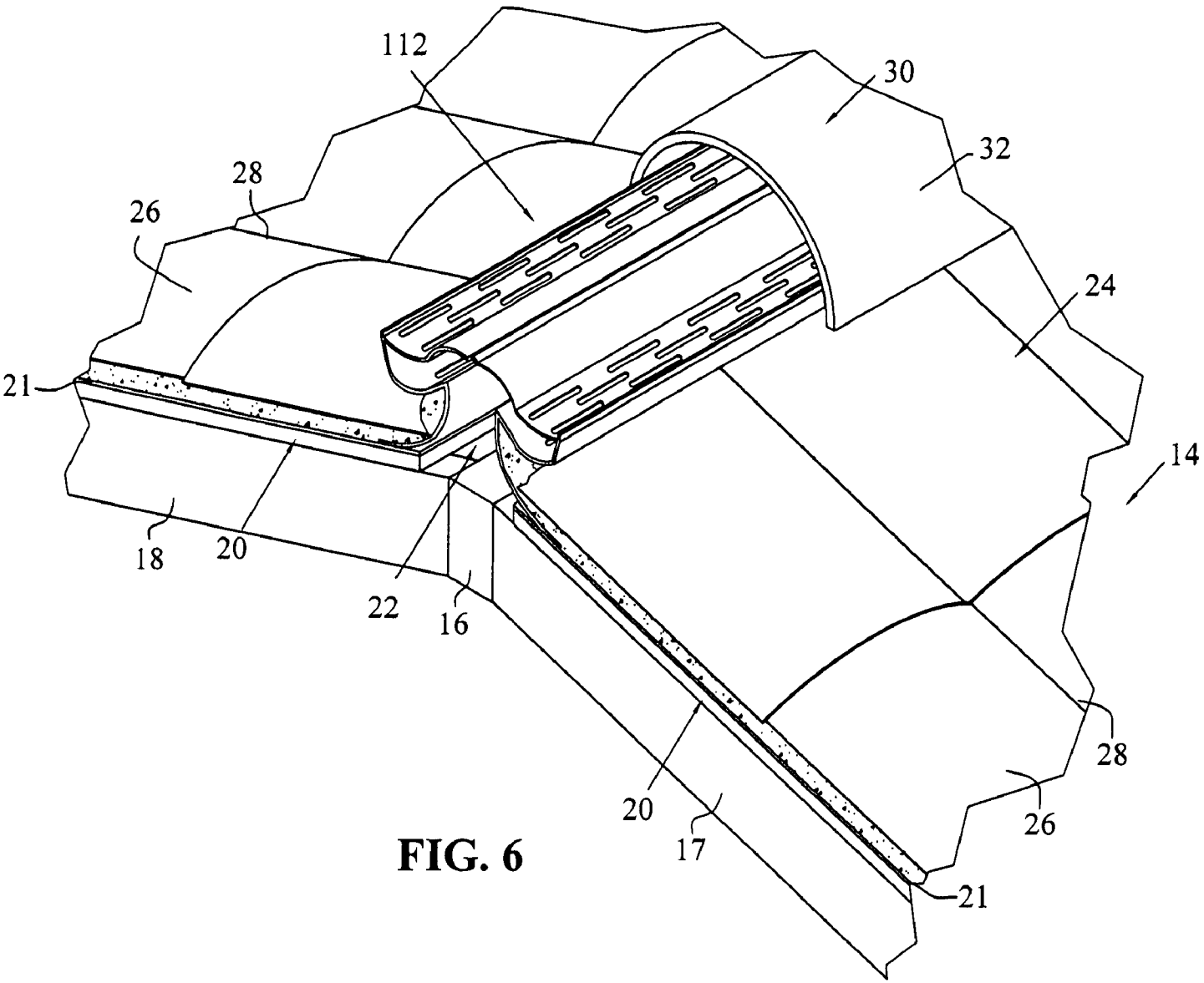
FIG. 6 is a partial top perspective view of a structure having a ridge vent according to a second embodiment of the present invention with one of the capping tiles removed to better show the ridge vent.
Figure 7:
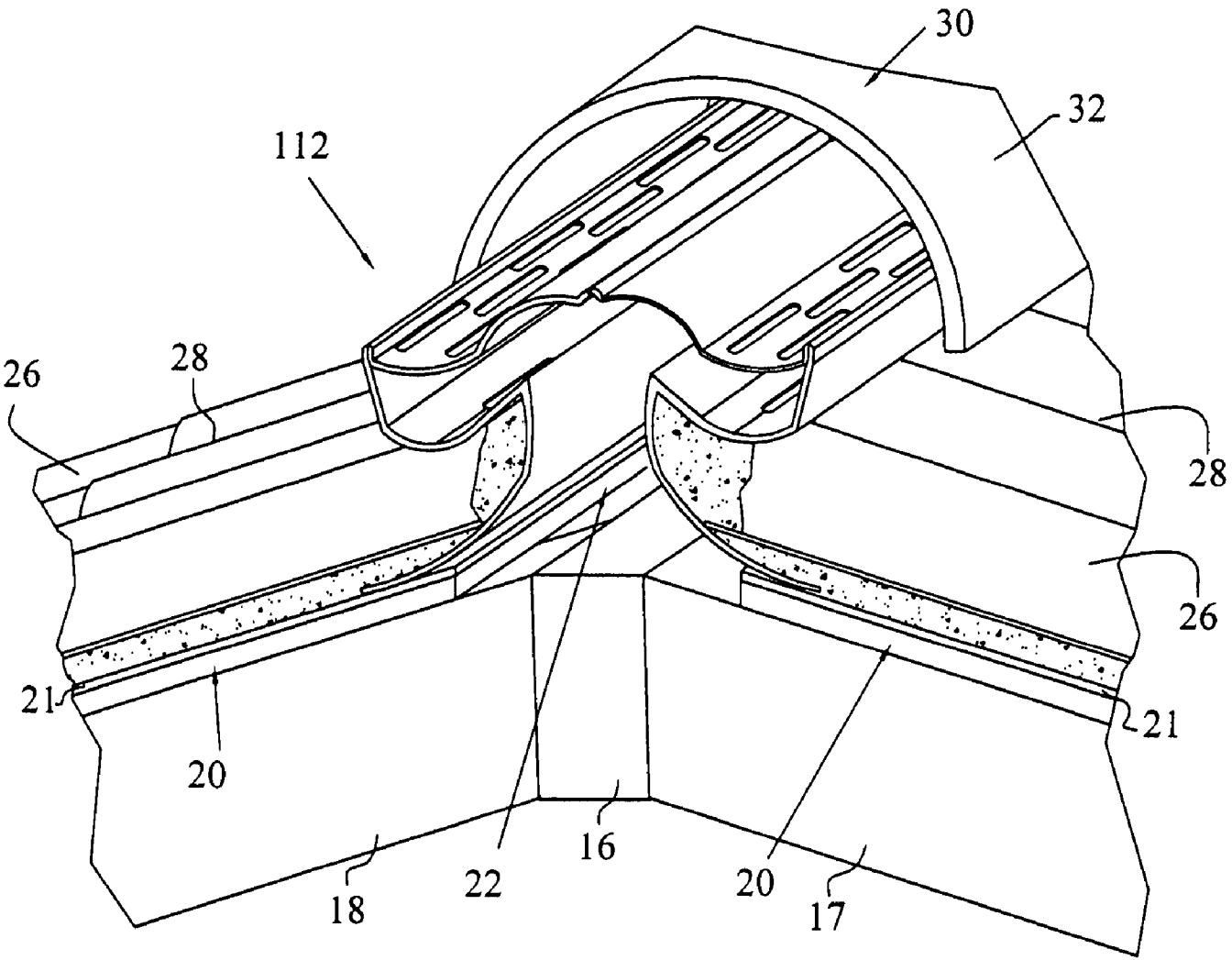
FIG. 7 is a partial perspective view of the ridge vent of FIG. 6 at a different angle.
Figure 8:
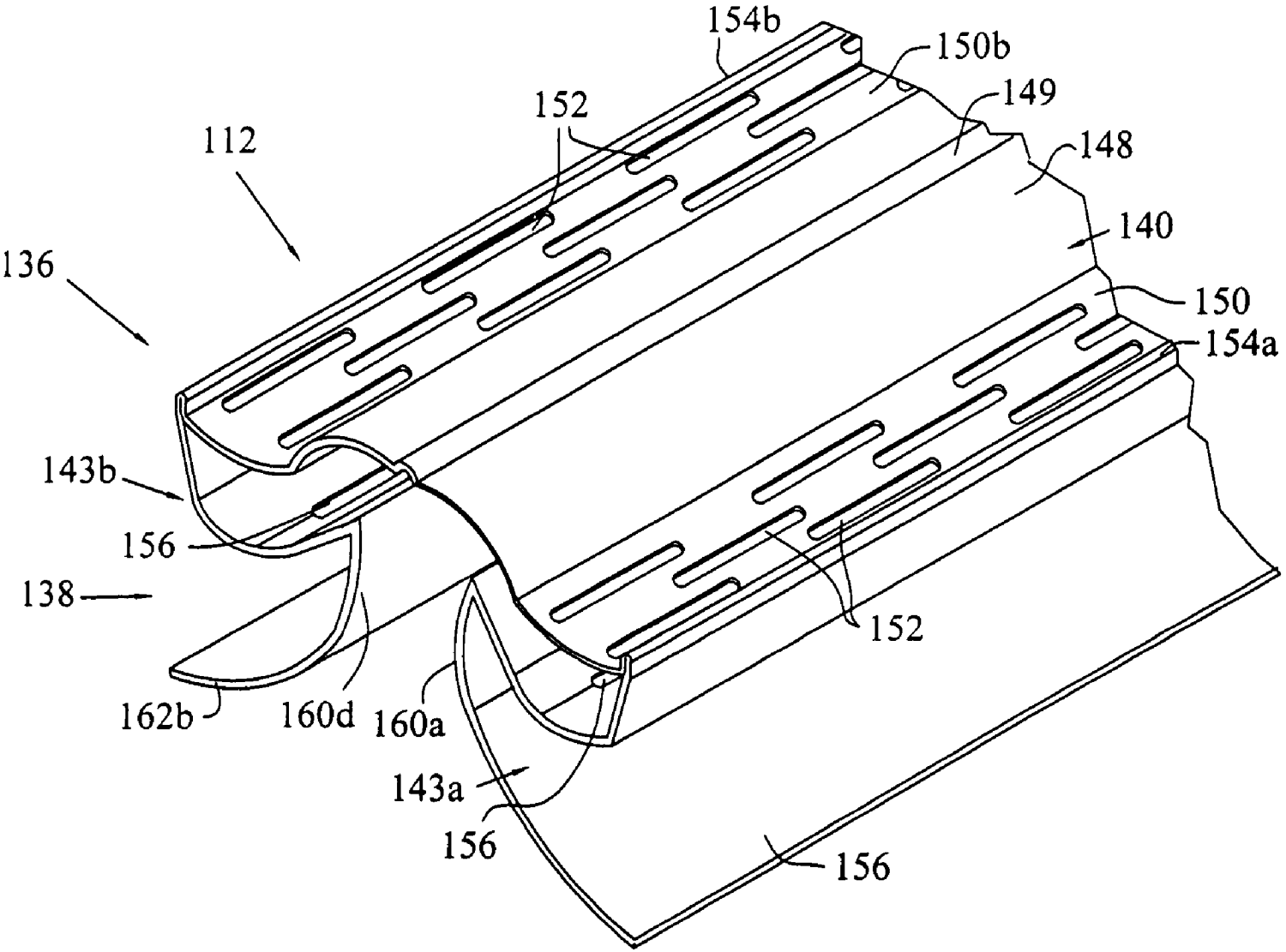
FIG. 8 is a partial perspective view of the ridge vent of FIG. 6 removed from the roof.
Figure 9:
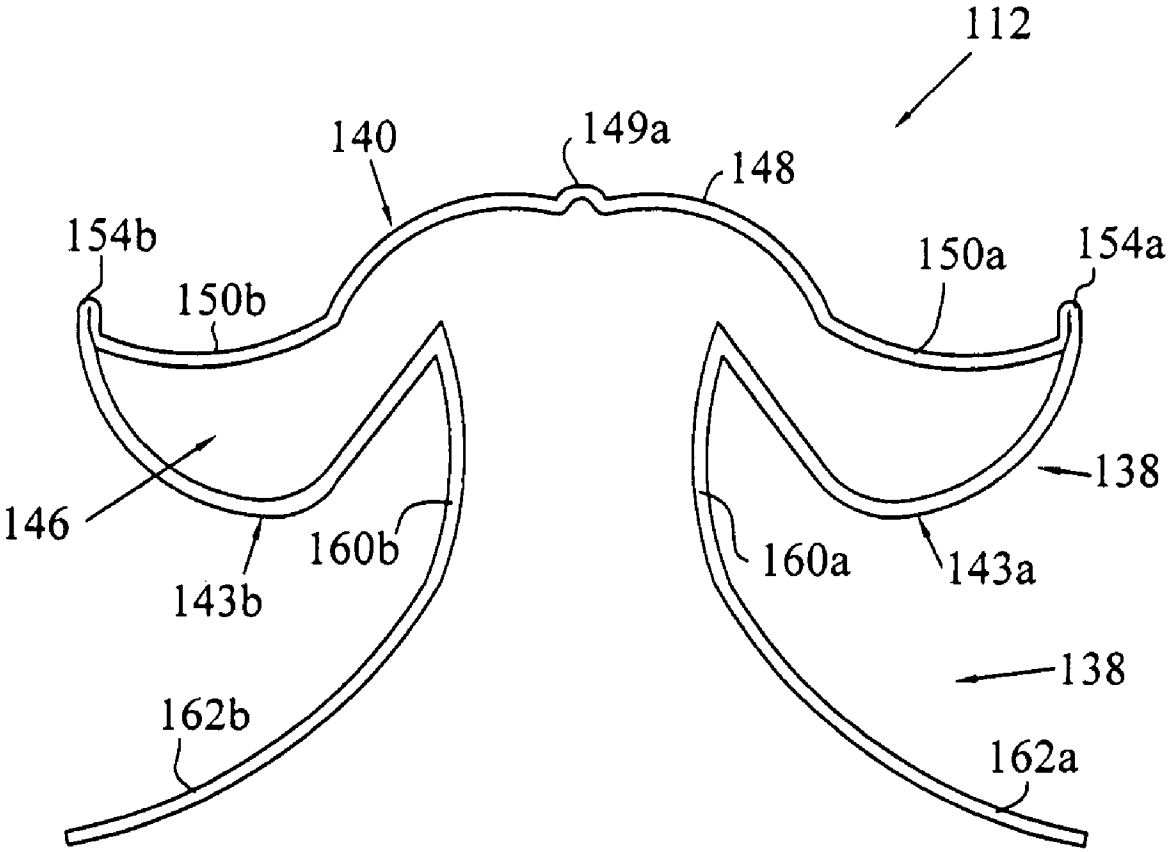
FIG. 9 is an end view of the ridge vent of FIG. 6 removed from the roof.
Figure 10:
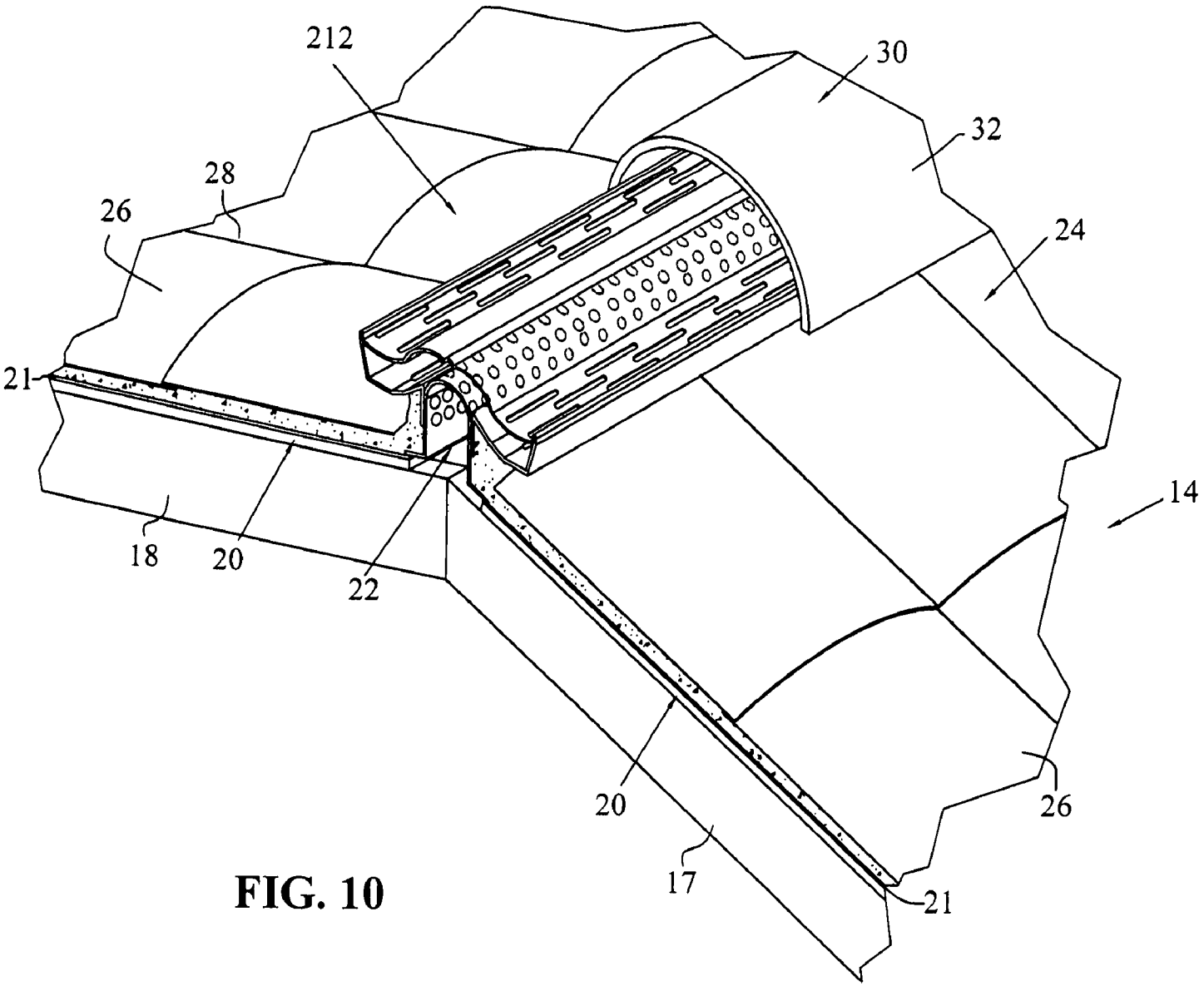
FIG. 10 is a partial top perspective view of a structure having a ridge vent according to a third embodiment of the present invention with one of the capping tiles removed to better show the ridge vent.
Figure 11:
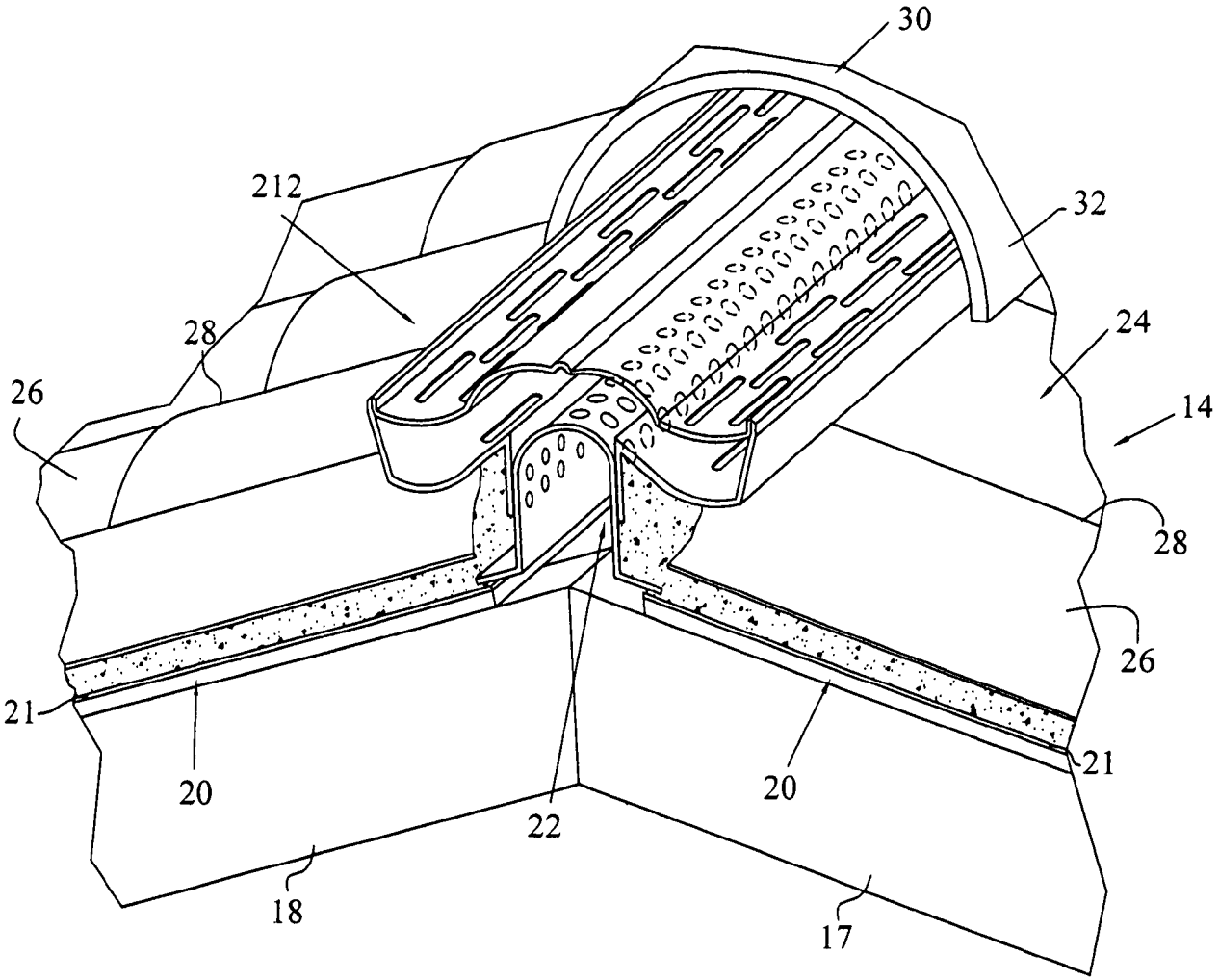
FIG. 11 is a partial perspective view of the ridge vent of FIG. 10 at a different angle.
Figure 12:
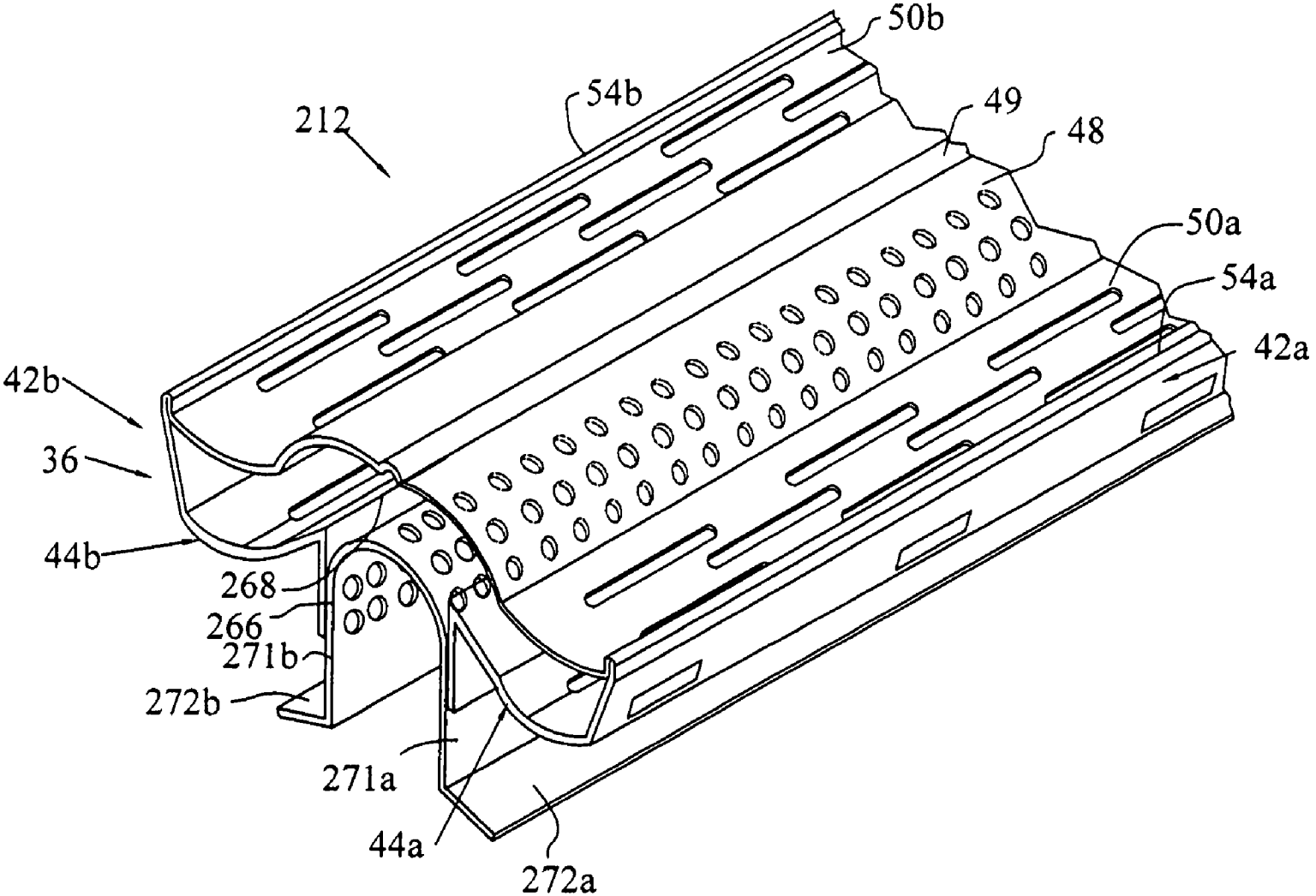
FIG. 12 is a partial perspective view of the ridge vent of FIG. 10 removed from the roof.
Figure 13:
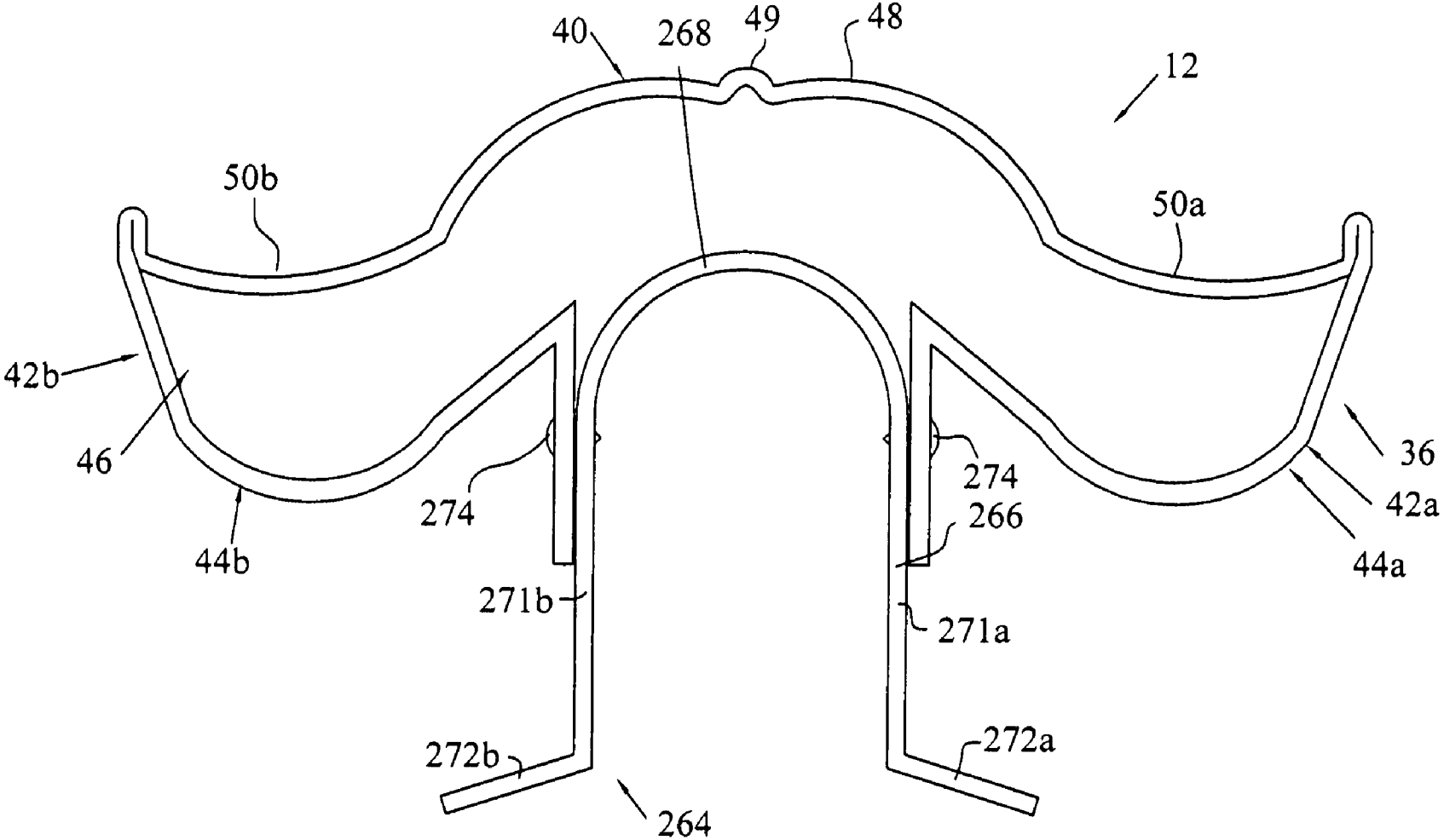
FIG. 13 is an end view of the ridge vent of FIG. 10 removed from the roof.
Figure 14:
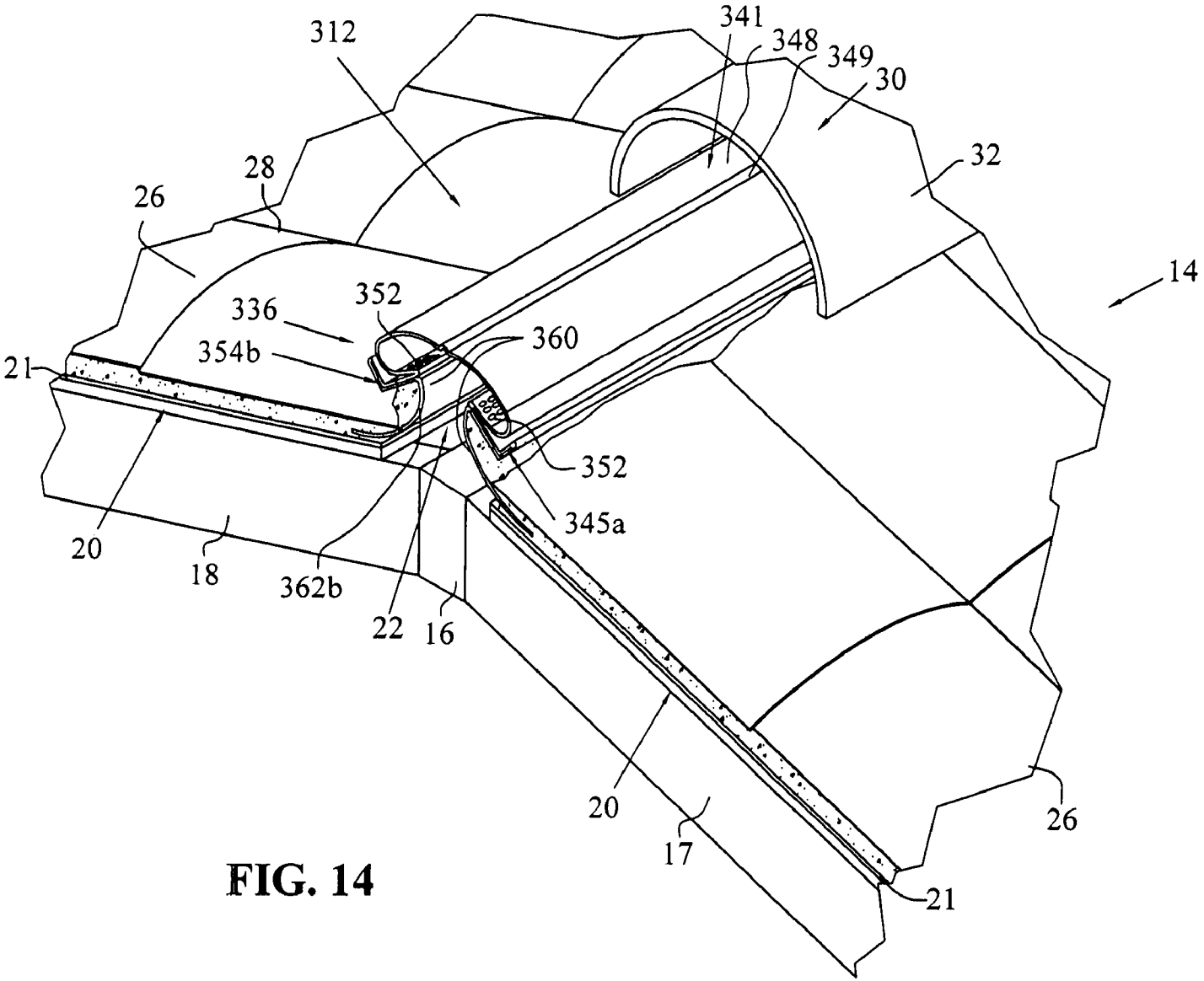
FIG. 14 is a partial top perspective view of a structure having a ridge vent according to a fourth embodiment of the present invention with one of the capping tiles removed to better show the ridge vent.
Figure 15:
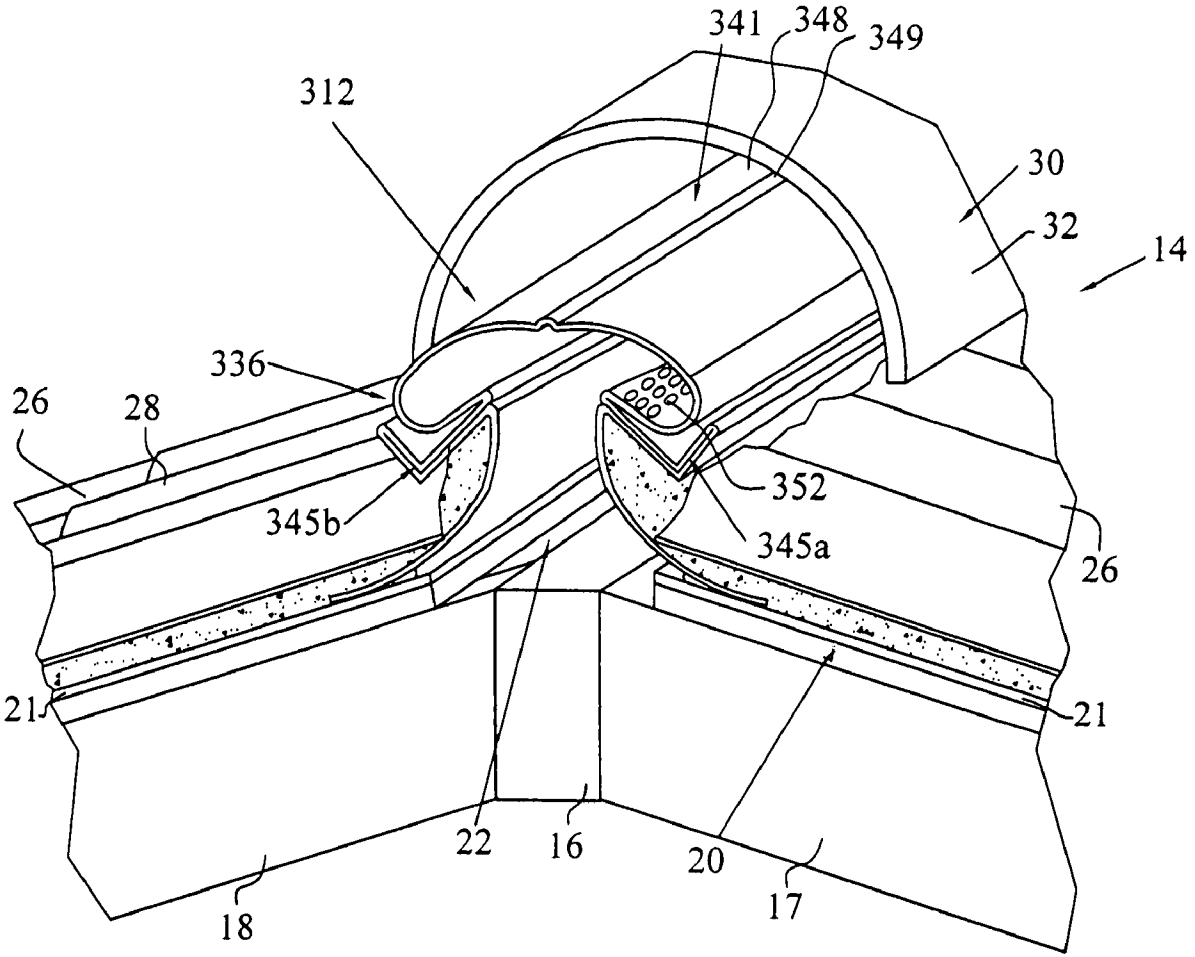
FIG. 15 is a partial perspective view of the ridge vent of FIG. 14 at a different angle.
Figure 16:
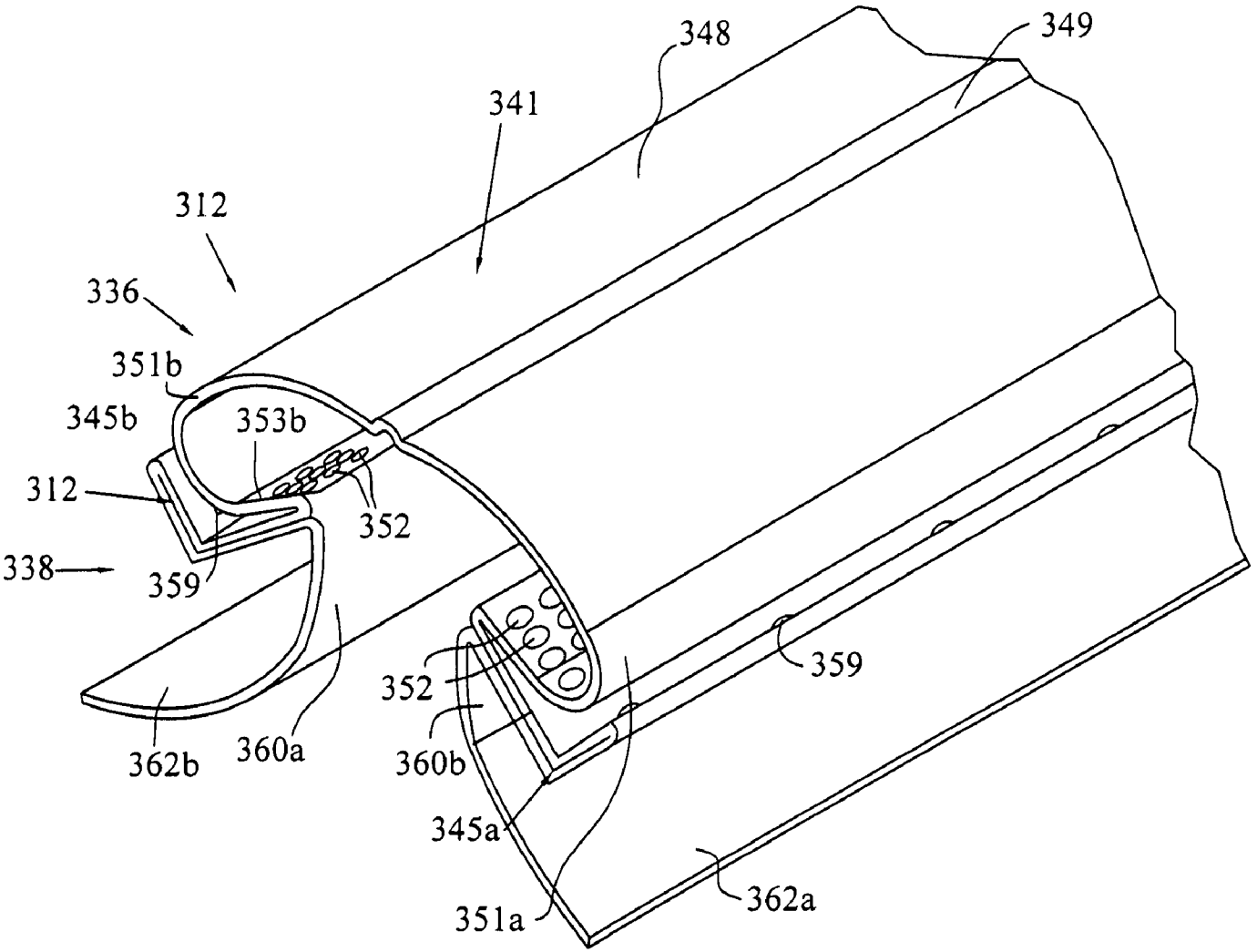
FIG. 16 is a partial perspective view of the ridge vent of FIG. 14 removed from the roof.
Figure 17:
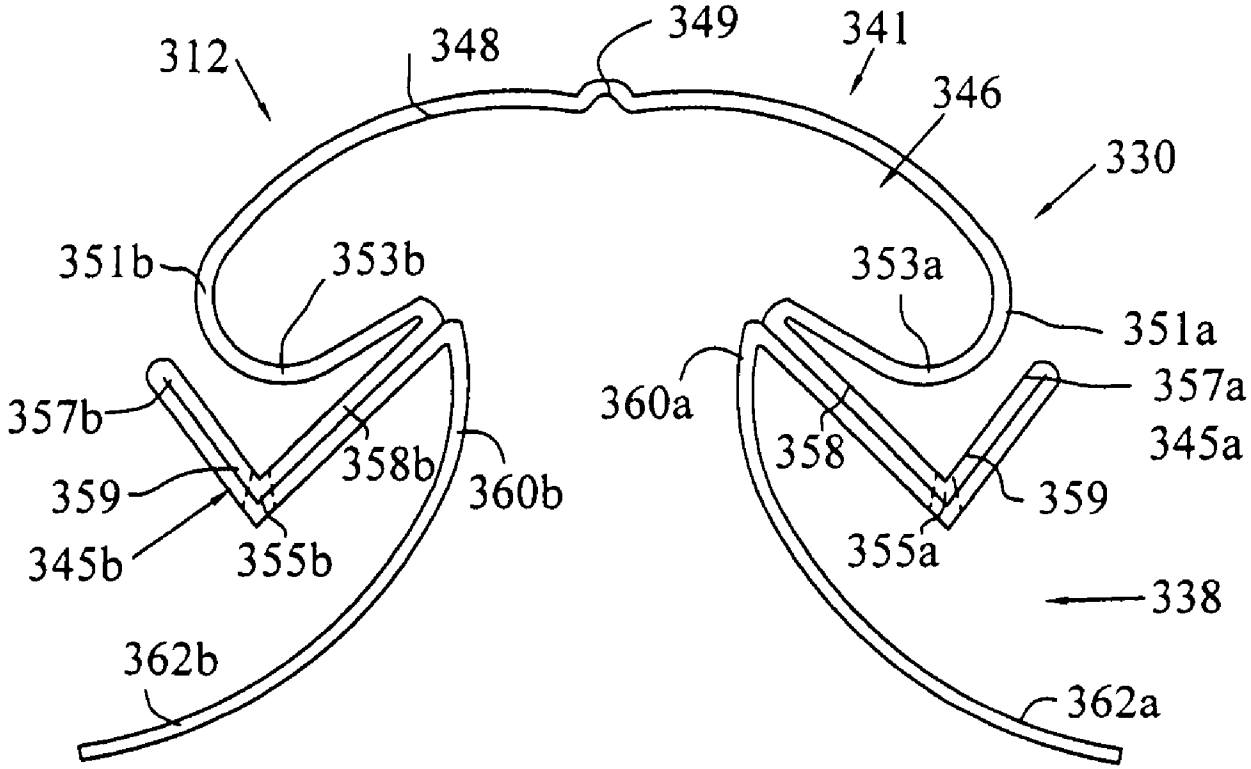
FIG. 17 is an end view of the ridge vent of FIG. 14 removed from the roof.

Referring to FIGS. 4 and 5 in the embodiment shown, vent member 12 has a one-piece configuration that may be formed by bending and rolling a sheet metal, or by an extrusion process. Of course, vent member 12 may also be manufactured by joining several pieces of material together by welding, using adhesive or by using fasteners. Vent member 10 includes an upper portion generally indicated as 36 and a lower portion generally indicated as 38. Upper portion 36 has an upper wall generally indicated as 40, a pair of side walls generally indicated as 42*a*, 42*b* and a pair of lower walls generally indicated as 44*a*, 44*b*, which together define an interior cavity in upper portion 36 generally indicated as 46.

Upper wall 40 of the upper portion 36 of vent member 12 includes a domed center 48 having an apex 49 and a pair of longitudinally extending gulleys or recesses 50*a*, 50*b* extending longitudinally along the length of vent member 12. Upper wall 40 also includes a plurality of exhaust ports or holes 52. In this embodiment, as best shown in FIG. 4, exhaust ports 52 have a circular configuration and are located in longitudinal gulleys 50*a* and 50*b*.

Vent part 12 also includes vertically oriented lips or projections 54*a*, 54*b* in the transition area between upper wall 40 and side walls 42*a*, 42*b*, respectively. Side walls 42*a*, 42*b* also include drainage holes or slots 56 spaced along the length of vent member 12. Drainage holes 56 are located slightly above the lower end of the side walls that coincide with the transition area to lower walls 44*a*, 44*b*.

Lower walls 44*a*, 44*b* slope upwardly from the outer transition area, where they are connected to side walls 42*a*, 42*b*, respectively, to the highest point, where the upper portion 36 transitions to the lower portion 38 for purposes of moisture drainage, which will be discussed below.

Lower portion 38 of vent member 12 includes transition portions 60*a*, 60*b* connected to lower walls 44*a*, 44*b*, respectively, and flared flexible mounting flanges 62*a*, 62*b*. Transition portions 60*a*, 60*b* extend generally parallel to one another in a generally vertical orientation, while flexible mounting flanges 62*a*, 62*b* extend outwardly in opposite directions from one another for use in mounting vent member 12 to roof 14. The flexible mounting flanges 62*a*, 62*b* are manufactured from a thin sheet metal or otherwise formed from a material that is thin enough and flexible enough to allow the flanges to be pulled apart so that vent member 12 can be mounted to the roof and to accommodate vent openings 22 of different widths.

To assemble ventilating apparatus 10, roof tiles 24 may be installed on sheathing 20 to form a protective covering for the roof; however, it is best to wait to place the last row of tiles 24 that form edges 25 until after vent member 12 is mounted. The roof tiles are mounted in a manner as is well known to one skilled in the art. To mount vent member 12, flexible mounting flanges 62*a*, 62*b* are pulled apart to span over ridge board 16 and vent opening 22. The flexible nature of mounting flanges 62*a*, 62*b* enable the width/configuration of the lower portion 38 to be varied as shown by the phantom lines in FIG. 5 to accommodate a wide variety of widths of the vent opening. The ends of mounting flanges 62*a*, 62*b* are then nailed, adhered or otherwise affixed to sheathing 20 in order to mount vent member 12 in place. The upper rows of tiles 24 may then be laid in the same known manner with edges 25 overlapping the ends of mounting flanges 62*a*, 62*b*. The space between vent member 12 and tiles 24 can then be filled in with mortar or mastic material 29. Preferably, the mortar or mastic material will extend up to lower walls 44*a*, 44*b* of upper portion 36 of vent member 12; however, the mortar should not extend above the bottom of side walls 42*a*, 42*b*, so that drainage holes 56 are not covered up. Ridge cap 30 may then be placed over vent member 12 using semi-circular ridge tile pieces 32. Ridge cap 30 may be affixed to vent member 12 by inserting screws or fasteners (not shown) through holes (not shown) in the tile pieces with the screws or fasteners affixed to upper wall 40 or side walls 42*a*, 42*b*.

In operation, ventilating apparatus 10 vents air from a structure covered by roof 14 out vent opening 22 and underneath ridge cap 30 and through valleys 28 of tiles 24. Hot air passes from the structure through vent openings 22 adjacent ridge member 16 and then to the space between flexible flanges 62, 62*b* and transition portions 60*a*, 60*b*. The air can then flow up and into interior cavity 46 and out of exhaust ports 52. From there, the air vents from underneath ridge cap 30 through the valleys 28 of tiles 24.

This design also inhibits moisture from snow or rain or other debris from entering the structure through vent opening 22. Any moisture blown beneath ridge cap 30 through valleys 28 is either blocked by side walls 42*a*, 42*b* or mortar 29 from entering the opening, or if moisture is blown into interior cavity 46 through drainage holes 56, then the slope in lower walls 44*a*, 44*b* directs the moisture back out of the drainage holes from which it entered. Furthermore, the configuration of vent 12, and in particular lips 54*a*, 54*b* and apex 49 tend to direct any air that blows beneath ridge cap 30 up towards the ridge cap and out the other side of the ridge cap from where it is entered as demonstrated by the air flow lines shown in FIG. 5. Accordingly, any moisture or debris traveling with the air flow/wind tends to be blown out the other side of the ridge cap as opposed to being deposited on vent member 12 or in vent opening 22. In addition, if rain or snow is deposited on the vent member, then lips 54*a*, 54*b* and domed center 48 direct the moisture into longitudinal gulleys 50*a*, 50*b*. From there, the moisture flows through exhaust ports 52 into interior cavity 46, where the slope of lower walls 44*a*, 44*b* directs the moisture to drainage holes 56, where it drains out of vent member 12 and onto tiles 24 to be drained from the roof.

Now referring to FIGS. 6-9, another embodiment of a vent member is generally indicated as 112. Vent member 112 is similar to vent member 12 and is mounted to roof 14 in a similar manner. Vent member 112 includes an upper portion 136 and a lower portion 138. Upper portion 136 has an upper wall generally indicated as 140 and a pair of generally U-shaped walls 143*a*, 143*b*, which together define an interior cavity in upper portion 136 generally indicated as 146.

Upper wall 140 of upper portion 136 of vent member 112 includes a domed center 148 having an apex 149 and a pair of longitudinally extending gullies or recesses 150*a*, 150*b* extending longitudinally along the length of vent member 112. Upper wall 140 also includes a plurality of exhaust ports 152. In this embodiment, as best shown in FIG. 4, exhaust ports 152 have a slotted configuration and are located in longitudinal gullies 150*a* and 150*b*.

Vent member 112 also includes extended lips or projections 154*a*, 154*b* in a transition period between upper wall 140 and each of the U-shaped walls 143*a*, 143*b*, respectively. U-shaped walls 143*a*, 143*b* also include drainage holes or slots 156 that are located at the bottom of the U or slightly above the bottom to the outer sides of the vent part.

Lower portion 138 of vent member 112 includes transition portions 160*a*, 160*b* connected to U-shaped walls 143*a*, 143*b*, respectively, and flared flexible mounting flanges 162*a*, 162*b*. Transition portions 160*a*, 160*b* extend generally parallel to one another in a generally vertical orientation, while flexible mounting flanges 162*a*, 162*b* extend outwardly in opposite directions from one another for use in mounting vent member 112 to roof 14. As with vent member 12, flexible mounting flanges 62*a*, 62*b* should be flexible enough to allow the flanges to be pulled apart to accommodate vent openings 22 of different widths. Vent member 112 is mounted to roof 14 and operates the same as vent member 12.

Now referring to FIGS. 10-13, a third embodiment of a vent member is shown generally indicated as 212 and mounted on roof 12. All aspects of the roof and tiles are the same for vent member 212 as with vent member 12. Furthermore, the upper portion of vent member 212 is identical to that of 112. However, vent member 212 includes a lower portion 238 with transition portions 260*a*, 260*b*, but does not include a flared flexible mounting flanges on the end of the transition portion. Rather, transition portions 260*a*, 260*b* terminate in a generally parallel and vertical orientation.

To mount vent member 212 to roof 14, a mounting member generally indicated as 264 is provided. Mounting member 264 allows the height at which vent member 212 is mounted above sheeting 20 to be adjusted. In the embodiment shown, mounting member 264 includes a generally U-shaped portion 266 with a base 268 of the U being oriented upwards and including vent holes 270 therethrough. U-shaped portion 266 also includes a pair of legs 271*a*, 271*b*. At the other end of U-shaped portion 266, mounting member 264 includes a pair of mounting flanges 272*a*, 272*b*. In the embodiment shown, mounting flanges 272*a*, 272*b* flare out at an angle from respective ends of U-shaped portion 266 and need not be flexible as mounting flanges 62*a*, 62*b* and 162*a*, 162*b*. However, it should be realized that flared flexible mounting flanges similar to 162*a*, 162*b* may be substituted for the fixed angled mounting flanges 272*a*, 272*b*.

To mount vent member 212, flanges 272*a*, 272*b* are attached to sheathing 20 using nails, adhesives or other fasteners as with the other embodiments. Vent member 212 is then placed over mounting member 264 with transition portions 60*a*, 60*b* flanking the legs of U-shaped portion 266. When vent member 212 is at the desired height, transition portions 260*a*, 260*b* can be attached to legs 271*a*, 271*b*, respectively, of U-shaped portion 266 using screws or other fasteners 274. When assembled thusly, air venting through vent opening 22 can vent through vent holes 270 into the interior cavity of vent member 212 and vent out the exhaust ports therein. It should also be appreciated that vent member 212 or any of the other embodiments of vent members disclosed herein and/or mounting member 264 may be stiffened with braces spanning an interior portion thereof or by the use of stiffening members having vent passages such as corrugated plastic.

Another embodiment of a vent member generally indicated as 312 is shown in FIGS. 14-17. Vent member 312 includes an upper portion 336 and a lower portion 338. Upper portion 336 includes a curved oblong part 341 and deflector members generally indicated as 345*a*, 345*b*. Curved oblong part 341 includes a domed center 348, an apex 349 and pair of protuberances 351*a*, 351*b* at the sides thereof. Curved oblong part 341 also defines an interior cavity generally indicated as 346 and a pair of trenches 353*a*, 353*b* in the interior cavity 346 of protuberances 351*a*, 351*b*, respectively. Exhaust ports 352 are located in the trench region of protuberances 351*a*, 351*b* for venting air from vent opening 22. Deflector members 345*a*, 345*b* have a generally V-shaped configuration with angled corners or bases 355*a*, 355*b*; outer legs 357*a*, 357*b*; and inner legs 358*a*, 358*b*. Deflector members 345*a*, 345*b* also include drainage holes or slots 359 and outer legs 357*a*, 357*b* just above angled corners 355*a*, 355*b*, respectively. As can be best seen in FIGS. 16 and 17, vent member 312 can be manufactured from a single piece of rolled and bent sheet material. If made in this manner, deflector members 345*a*, 345*b* will have a double layered configuration. The lower portion 338 of vent member 12 is the same or similar to vent member 12 and includes a transition portions 360*a*, 360*b* and flared flexible mounting flanges 362*a*, 362*b*.

Vent member 312 is mounted the same as vent member 12 and the mortar seal should preferably extend up to angled corners 355*a*, 355*b*, but not cover drainage holes 359. Vent member 312 also operates similarly to vent member 12 by venting air escaping through vent opening 22 of roof 14. The vented air enters the lower portion 338 of vent member 312 as mounting flanges 362*a*, 362*b* straddle the vent opening. The air rises into interior cavity 46 and out of the upper portion 336 through exhaust ports 352. Rain, snow and other debris is prevented from entering vent opening 22 as deflector members 345*a*, 345*b* block and protect exhaust ports 352. Furthermore, should any moisture enter into interior portion 346, it will drain back through exhaust ports 352 which are located in trenches 353*a*, 353*b* of protuberances 351*a*, 351*b* in curved oblong part 341. Any moisture draining out of the exhaust ports will be caught by deflector members 345*a*, 345*b*, and the V-shape configuration will direct the moisture to drain from drainage holes 359 out onto tiles 24 to be drained from the roof.

Figure 18:
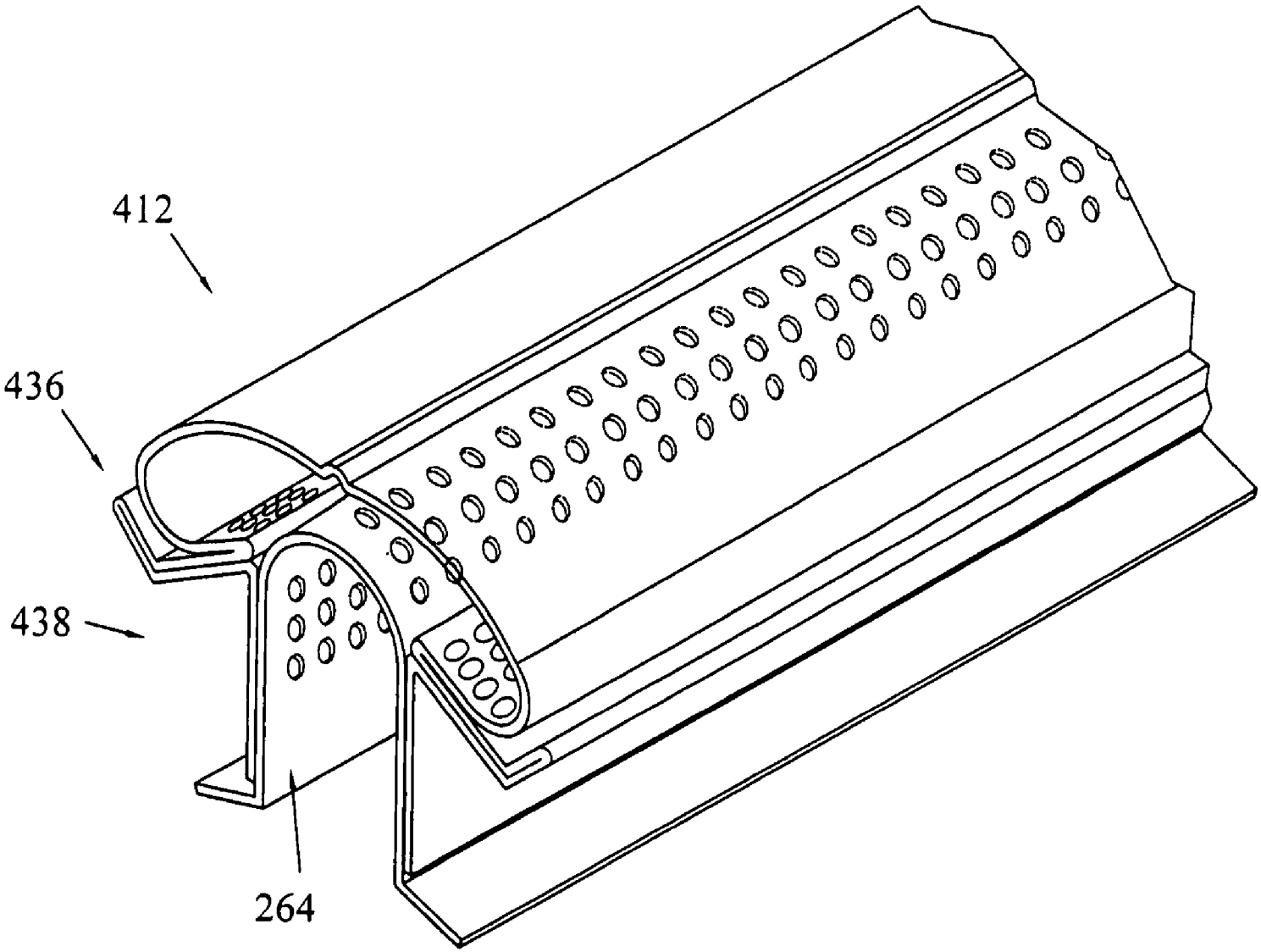
FIG. 18 is a partial top perspective view of a ridge vent according to a fifth embodiment of the present invention removed from the roof.
Figure 19:
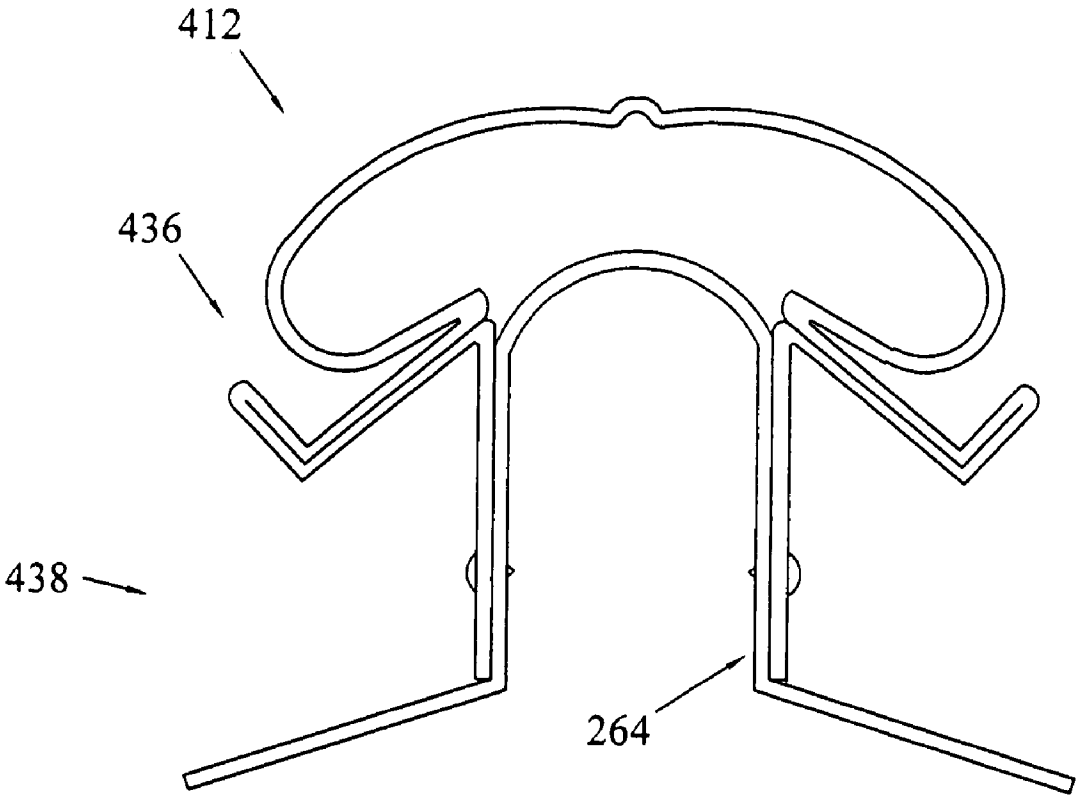
FIG. 19 is an end view of the ridge vent of FIG. 18 removed from the roof.

Now referring to FIGS. 18 and 19, another embodiment of a vent member is generally indicated as 412. Vent member 412 has an upper portion 436 that is identical to the upper portion 336 of vent member 312; however, vent member 412 has a lower portion 438 that is the same as lower portion 238 of vent member 212. As such, vent member 412 is designed to be mounted to roof 14 using mounting member 264. Accordingly, vent member 412 is mounted to roof 14 in the same manner as vent member 212 so that the height can be adjusted by fastening the lower portion to the mounting member at the desired height. Vent member 412 operates the same as vent member 312.

Figure 20:
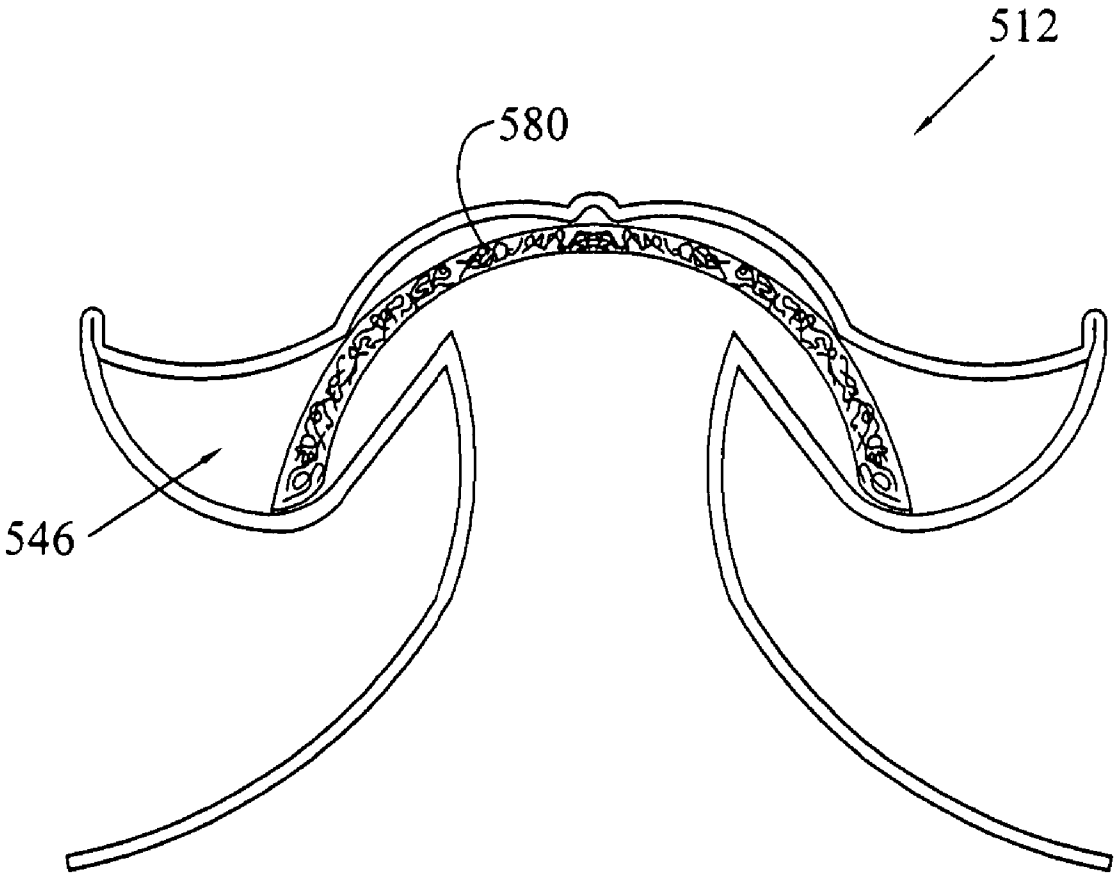
FIG. 20 is an end view of a ridge vent similar to the ridge vent of FIG. 9 with a filter media disposed in an interior cavity thereof.

Another embodiment of a vent member is generally indicated as FIG. 512 in FIG. 20. Vent member 512 has construction similar to vent member 112 and includes an interior cavity generally indicated as 546. Located in interior cavity 546 is a filter media 580 which provides additional protection to exclude moisture and debris from entering vent opening 22. It should be appreciated that any moisture blocked by the filter media will drain out of the drainage holes of the vent member. The filter media may be of any air permeable water-resistant material in either a sheet or blanket form. It may include woven or non-woven fabrics as well as air permeable water resistant membranes that are not of fabric. The filter media may also be non-woven spun bonded material of randomly arranged synthetic polymer fibers. It should also be appreciated that the filter media may be located on the exterior of vent member 512 as shown in commonly owned U.S. application Ser. No. 10/352,415, filed on Jan. 28, 2003, and which is incorporated in its entirety herein by reference.

Figure 21:
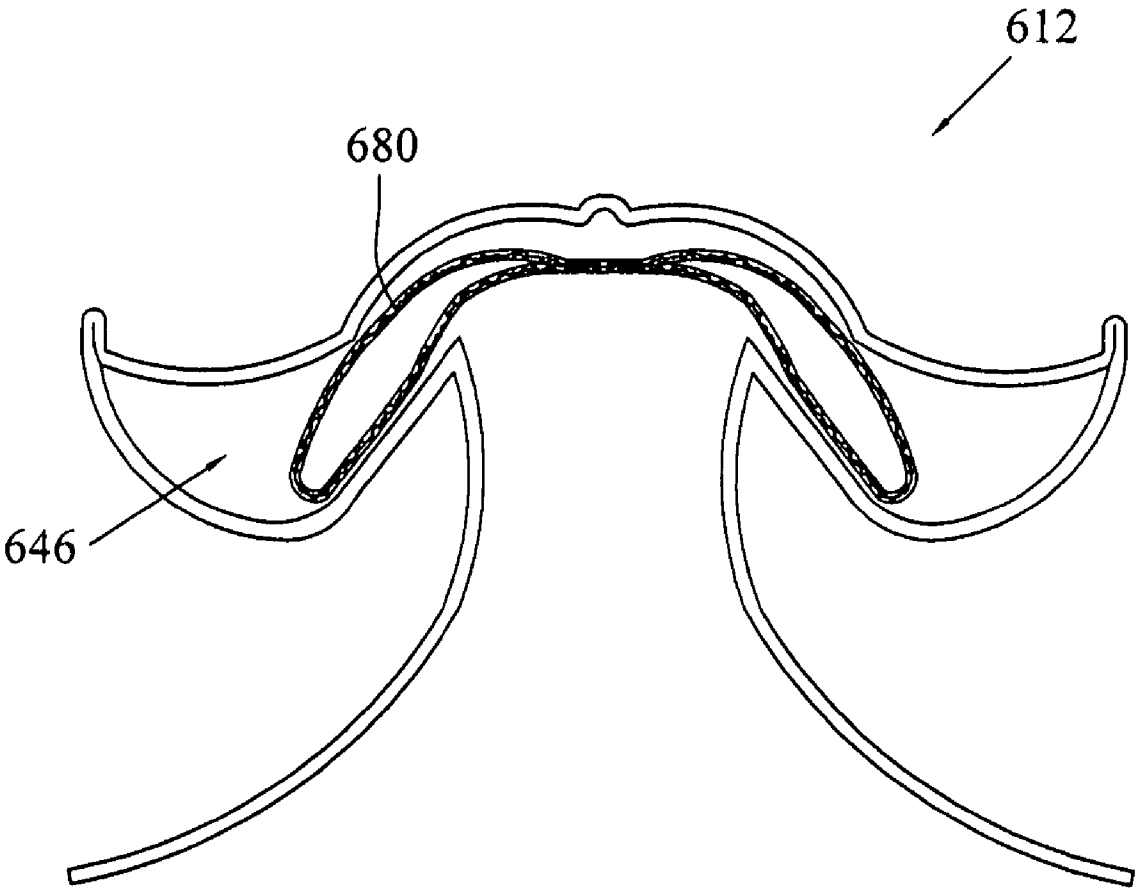
FIG. 21 is an embodiment similar to that of FIG. 20 with a filter fabric substituted for the filter media.

Another embodiment of a vent member is shown generally indicated as 612 in FIG. 21. Vent member 612 is similar to vent member 512 and includes a filter media 680. Filter media 680 is made from a thin air permeable moisture resistant fabric and has a figure-8 configuration. Filter media 680 is placed in an interior cavity 646 of vent member 612 to keep moisture and debris from entering vent opening 22. The material used for filter media 680 is preferably sufficiently stiff to maintain the configuration shown during use.

While the invention has been taught with specific reference to the described embodiments, one skilled in the art will recognize that changes can be made in form and detail without departing from the spirit and scope of the invention. The described embodiments are to be considered in all respects only as illustrative and not restrictive. The scope of the invention is, therefore, indicated by the following claims rather than by the description.

The invention claimed is:

1. A ventilating apparatus for a roof having a longitudinally extending ridge member and a vent opening substantially co-extensive with the ridge member, said ventilating apparatus comprising:

a vent member mounted above the ridge member and extending longitudinally along the length of the vent opening, said vent member including a plurality of vent passages communicating the vent opening to ambient atmosphere, said vent member including an upper wall, a pair of side walls, a pair of lower walls extending directly beneath the upper wall, and a pair of flexible mounting flanges that provide an adjustable mount to the roof on opposite sides of the vent opening to accommodate vent openings of different widths, said flexible mounting flanges having a rounded configuration curving outwardly away from a center line of said ventilating apparatus so that said mounting flanges have a continually changing slope; and a capping structure extending longitudinally above the ridge member, covering the ridge member and the vent opening so that air ventilating from the vent opening passes within a space between said capping structure and the roof.

2. The ventilating apparatus as set forth in claim 1, wherein the roof is covered by tiles.

3. The ventilating apparatus as set forth in claim 1, wherein said upper wall includes recessed areas formed in an outer surface of said upper wall and having exhaust ports in said recessed areas.

4. The ventilating apparatus as set forth in claim 3, wherein said side walls include drainage holes for draining moisture entering said exhaust ports in said upper wall.

5. The ventilating apparatus as set forth in claim 1, wherein said upper wall of said vent member is mounted to said capping structure.

6. The ventilating apparatus as set forth in claim 1, further including a pair of deflector members mounted on opposite sides of said vent member with each of said deflector members extending outwardly beyond the respective side wall.

7. The ventilating apparatus as set forth in claim 6, wherein said vent member has exhaust ports in at least one of said side walls or lower walls.

8. The ventilating apparatus as set forth in claim 7, wherein said deflector members include moisture drainage holes.

9. The ventilating apparatus as set forth in claim 8, wherein said deflector members have a substantially V-shaped configuration.

10. The ventilating apparatus as set forth in claim 9, wherein said drainage holes are located in outer legs of said v-shaped deflector members, slightly above the base of the V.

11. The ventilating apparatus as set forth in claim 1, wherein said mounting flanges are adjustably fixed to said vent member to permit the height of the ventilating apparatus to be adjusted.

12. A ventilating apparatus for a roof having a longitudinally extending ridge member and a vent opening substantially coextensive with the ridge member, said ventilating apparatus comprising:

a vent member mounted above the ridge member and extending longitudinally along the length of the vent opening, said vent member including a plurality of vent passages communicating the vent opening to ambient atmosphere, said vent member including an upper wall, a pair of side walls, a pair of lower walls, and a pair of mounting flanges, said upper wall including at least one longitudinally extending concave gulley formed in and along an outer surface of said upper wall and having plurality of openings along each gully, at least one of said side walls or lower walls include drainage holes for draining moisture entering said exhaust ports in said upper wall; and a capping structure extending longitudinally above the ridge member, covering the ridge member and the vent opening so that air ventilating from the vent opening passes within a space between said capping structure and the roof.

13. The ventilating apparatus as set forth in claim 12, wherein the roof is covered by tiles.

14. The ventilating apparatus as set forth in claim 12, wherein said upper wall of said vent member is mounted to said capping structure.

15. The ventilating apparatus as set forth in claim 12, further including a pair of deflector members mounted on opposite sides of said vent member with each of said deflector members extending outwardly beyond the respective side wall.

16. The ventilating apparatus as set forth in claim 7, wherein said deflector members include moisture drainage holes.

17. The ventilating apparatus as set forth in claim 8, wherein said deflector members have a substantially V-shaped configuration.

18. The ventilating apparatus as set forth in claim 1, wherein said mounting flanges are adjustably fixed to said vent member to permit the height of the ventilating apparatus to be adjusted.

19. The ventilating apparatus as set forth in claim 12, wherein said mounting flanges are flexible to provide an adjustable mount to the roof on opposite sides of the vent opening to accommodate vent openings of different widths.

20. A ventilating apparatus for a roof having a longitudinally extending ridge member and a vent opening substantially coextensive with the ridge member, said ventilating apparatus comprising:

a one-piece vent member formed from a sheet metal to be mounted above the ridge member and extending longitudinally along the length of the vent opening, said vent member including a plurality of vent passages communicating the vent opening to ambient atmosphere, said vent member including an upper wall, a pair of side walls, and a pair of lower walls, said walls defining an interior cavity in said vent member, and said upper wall including at least one longitudinally extending gulley in an outer surface of said upper wall and having plurality of openings along each gully for the vent passages and for collecting and draining water into said interior cavity, and drainage holes in at least one of said side walls or said lower walls for draining moisture from said interior cavity, said upper wall of said vent member including a plurality of projections projecting outwardly from an outer surface thereof to direct air flowing beneath a ridge cap covering the vent member up towards the ridge cap and out the other side of the ridge cap.

21. The ventilating apparatus as set forth in claim 20, further including a pair of flexible mounting flanges that provide an adjustable mount to the roof on opposite sides of the vent opening to accommodate vent openings of different widths.

22. The ventilating apparatus as set forth in claim 20, further including mounting flanges adjustably fixed to said vent member to permit the height of the ventilating apparatus to be adjusted.

23. The ventilating apparatus as set forth in claim 20, further including a filter media.

24. The ventilating apparatus as set forth in claim 23, wherein said filter media is located in said interior cavity.

25. The ventilating apparatus as set forth in claim 24, wherein said filter media is comprised of a thin elongate air permeable moisture resistant sheet in a figure-8 configuration.

26. A method for venting a building or structure comprising the steps of:

providing a roof having a longitudinally extending ridge member and a vent opening substantially coextensive with the ridge member;

providing a vent member having an upper portion with exhaust ports for venting air and defining an interior cavity, and drain holes for venting any moisture entering said cavity through said exhaust ports, and a lower portion for mounting said vent member, said upper portion of said vent member including projections, projecting outwardly from an outer surface thereof;

providing a pair of flexible mounting flanges attached to said lower portion said flexible mounting flanges having a rounded configuration curving outwardly away from a center line of said vent member so that said mounting flanges have a continually changing slope that provide a flexible mount on the roof on opposite sides of the vent opening to accommodate vent openings of different widths;

pulling the mounting flanges apart and mounting them to the roof on opposite sides of the vent opening using fasteners or adhesive;

providing a capping structure; and mounting said capping structure over said vent member to extend longitudinally thereabove, said projections directing air and moisture flowing thereby up towards said capping structure and out the other side thereof.

27. The method for venting a building or structure as set forth in claim 26, wherein said upper portion of said vent member includes at least one longitudinally extending gulley in an outer surface thereof, said exhaust ports being located in said gulley for directing moisture through said exhaust ports into said interior cavity.

28. The method for venting a building or structure as set forth in claim 26, wherein said mounting flanges are adjustably attached to said lower portion to allow the height of the vent member to be adjusted.

29. The method for venting a building or structure as set forth in claim 26, wherein said vent members include deflector members extending along the length thereof, and said drain holes are located in said deflector members.

30. The method for venting a building or structure as set forth in claim 26, wherein said vent member includes a filter media.

31. The method for venting a building or structure as set forth in claim 30, wherein said filter media is an air permeable, moisture resistant membrane located in said interior cavity.

32. The method for venting a building or structure as set forth in claim 31, wherein said filter media is an elongate sheet of material folded in a figure-8 configuration.

* * * * *